US006710796B1

(12) United States Patent
Miyazaki et al.

(10) Patent No.: US 6,710,796 B1
(45) Date of Patent: Mar. 23, 2004

(54) OPTICAL PRINTER WITH COLOR FILTER AND OPTICAL PRINTING METHOD

(75) Inventors: Takao Miyazaki, Saitama (JP); Keizo Uchioke, Tokyo (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 77 days.

(21) Appl. No.: 09/685,076

(22) Filed: Oct. 10, 2000

(30) Foreign Application Priority Data

Oct. 7, 1999 (JP) ..... 11-287314

(51) Int. Cl.[7] ..... B41J 27/00
(52) U.S. Cl. ..... 347/256; 347/241
(58) Field of Search ..... 347/238, 241, 347/256, 232, 242, 257, 243; 250/226; 358/512, 401; 355/27, 32; 396/548

(56) References Cited

U.S. PATENT DOCUMENTS

| | | | | | |
|---|---|---|---|---|---|
| 4,249,807 | A | * | 2/1981 | Webster et al. | 396/548 |
| 5,245,179 | A | * | 9/1993 | Chang | 250/226 |
| 5,434,600 | A | * | 7/1995 | Schoon | 347/243 |
| 5,572,285 | A | * | 11/1996 | Takagi | 355/27 |
| 5,870,131 | A | * | 2/1999 | Yuge et al. | 347/232 |
| 6,023,350 | A | * | 2/2000 | Nakao | 358/512 |
| 6,072,596 | A | * | 6/2000 | Hattori et al. | 358/401 |
| 6,342,940 | B1 | * | 1/2002 | Shimizu et al. | 355/32 |

FOREIGN PATENT DOCUMENTS

| | | | | |
|---|---|---|---|---|
| JP | 61-43736 | * | 3/1986 | G03B/33/00 |
| JP | 2-116562 | * | 5/1990 | B41J/2/445 |
| JP | 11-194429 | * | 7/1999 | G03B/27/32 |
| WO | 99-21055 | | 4/1999 | G03B/17/52 |

* cited by examiner

*Primary Examiner*—Hai Pham
(74) *Attorney, Agent, or Firm*—Sughrue Mion, PLLC

(57) ABSTRACT

An optical printer records a color image by exposing color instant photo film extending two-dimensionally in a main scan direction and a sub scan direction. The optical printer includes a printing head, which includes a white color light-emitting element and a color separation filter unit. The color separation filter unit is disposed in a light path of white-color light from the light-emitting element, for color separation of the white-color light. The color separation filter unit has a tubular shape, has a central axis extending substantially parallel with the main scan direction, and is rotatable about the central axis. The white-color light travels through an entrance position along the light path into the color separation filter unit, out of which the light travels through an exit position along the light path. The color separation filter unit includes three color filters, arranged about the central axis, having selectivity of a wavelength, for converting the white-color light into printing light of respectively single colors. The three color filters are so disposed that a single one thereof is in the entrance position or the exit position in a manner irrespective of a rotation position with reference to the central axis. Three transparent plates are arranged alternately with the three color filters.

8 Claims, 27 Drawing Sheets

OPTICAL PRINTER WITH COLOR FILTER AND OPTICAL PRINTING METHOD

BACKGROUND OF THE INVENTION

1. Field of the Invention

The present invention relates to an optical printer with a color filter and optical printing method, and more particularly, relates to an optical printer with a color filter and optical printing method in which printing light is applied to color photosensitive material to print a color image, and in which such an image can be printed efficiently.

2. Description Related to the Prior Art

An optical printer is a known device in which printing light of plural colors is applied to color photosensitive material for printing a color image thereto. The optical printer has a printing head, which includes a light source of white light and a color separation filter unit. The color separation filter unit is constituted by plural color filters of red, green and blue colors for converting light from the light source into the printing light of the red, green and blue colors. The printing head has a length of one line included in the color image, and is disposed to extend in a main scan direction. To record an entire frame of the color image, the printing head is moved relative to the color photosensitive material in the sub scan direction.

JP-A 11-127409 (corresponding to WO 99/21055) discloses a combined structure in which the optical printer is incorporated in an electronic still camera. An instant photo film is used as the color photosensitive material in the optical printer, which operates according to frame-sequential printing. The frame-sequential printing is a method in which colors are recorded frame after frame to obtain the color image. At first, a red one of the color filters is set in a light path. The printing head is moved in the sub scan direction, to record one red frame by use of red printing light. Then a green one of the color filters is set in the light path. The printing head is moved in the sub scan direction, to record one green frame by use of green printing light. After this, a blue one of the color filters is set in the light path. The printing head records one blue frame by use of blue printing light, to obtain the color image. Spreader rollers are operated to break a processing solution pod contained in the instant photo film, spread processing solution over an exposure surface to process the color image. The instant photo film is ejected at the same time.

The color separation filter unit has a plate shape in which the color filters are arranged adjacently to one another. The color separation filter unit is slid to set a selected one of the color filters in the light path.

However, the optical printer for the frame-sequential printing has shortcomings in efficiency. The instant photo film cannot be advanced toward the outside of the optical printer after the completion of three-color exposure. The printing head must be moved during recording. A space must be kept enough for moving the printing head. Also, a head moving mechanism is required for the printing head, and may cause the optical printer to have a considerably large size. Furthermore, a problem of the frame-sequential printing in the full color lies in very long time required for printing, as the printing head is moved back and forth for frames of three colors.

SUMMARY OF THE INVENTION

In view of the foregoing problems, an object of the present invention is to provide an optical printer and optical printing method in which printing light is applied to color photosensitive material to print a color image, and in which such an image can be quickly printed with a simple structure.

In order to achieve the above and other objects and advantages of this invention, an optical printer records a color image by exposing color photosensitive material extending two-dimensionally in a main scan direction and a sub scan direction. The optical printer comprises a printing head, which includes a light source and a color separation filter unit. The color separation filter unit is disposed in a light path of light from the light source, for color separation of the light from the light source, the color separation filter unit having a tubular shape, having a central axis extending substantially parallel with the main scan direction, being rotatable about the central axis, and into which the light from the light source travels through an entrance position along the light path, and out of which the light from the light source travels through an exit position along the light path. The color separation filter unit includes plural color filters, arranged about the central axis, having selectivity of a wavelength, for converting the light from the light source into printing light of respectively single colors, the plural color filters being so disposed that a single one thereof is in the entrance position or the exit position in a manner irrespective of a rotational position with reference to the central axis. Plural transmission portions or openings are arranged alternately with the plural color filters.

Furthermore, a filter drive mechanism rotates the color separation filter unit. A light amount adjustor adjusts a light amount of the printing light by each of pixels. A controller causes the filter drive mechanism to set in the light path a color filter among the plural color filters associated with a respective color to be recorded, and for operating the light amount adjustor according to density of the pixels of the respective color while the color filter is set in the light path.

The printing head is stationary. Furthermore, a feeder feeds the color photosensitive material in the sub scan direction, to cause the printing head to record the color image to the color photosensitive material.

The exit position is opposed to the entrance position with reference to the central axis. A total number of the plural color filters and the transmission portions or openings is $6(2n+1)$ where n is an integer equal to or more than zero, and the transmission portions or openings are opposed to respectively the plural color filters with reference to the central axis.

According to another preferred embodiment, furthermore, a reflector is disposed in the color separation filter unit, for reflecting light from the entrance position to cause the light to travel to the exit position.

The reflector is so disposed that the light from the entrance position is reflected substantially at a right angle to travel to the exit position. A total number of the plural color filters and the transmission portions or openings is $12(2n+1)$ where n is an integer equal to or more than zero.

The color separation filter unit further includes at least one ND filter for reducing the light amount of the printing light of at least one of the single colors.

The at least one ND filter is plural ND filters for constituting the plural transmission portions.

According to another preferred embodiment, the at least one ND filter is plural ND filters disposed to lie on respectively the plural color filters.

The color separation filter unit has a cylindrical shape.

According to another preferred embodiment, the color separation filter unit has a prismatic shape.

The light amount adjustor comprises a micro shutter, disposed in the light path, and of which transmittance density is variable by each of the pixels.

According to another preferred embodiment, the light source includes an array of plural light-emitting elements.

The light amount adjustor comprises a light-emitting element driver for driving the plural light-emitting elements by applying energy thereto according to the pixel density.

Furthermore, an encoder plate is secured to the color separation filter unit, has color information disposed in association with the plural color filters, for representing colors of the plural color filters. A phase detecting sensor reads the color information to recognize a color of one of the plural color filters set in the light path. The controller controls the light amount adjustor according to signal from the phase detecting sensor.

The plural color filters are disposed with respectively a first central angle about the central axis in the color separation filter unit. The color information is disposed with respectively a second central angle about a central axis in the encoder plate, the second central angle being smaller than the first central angle. The controller sends an image signal to the light amount adjustor, and the image signal starts being output after a portion of respectively the plural color filters comes in the light path, and finishes being output before an entirety of respectively the plural color filters comes out of the light path.

According to another preferred embodiment, the filter drive mechanism includes a stepping motor. The controller controls the stepping motor to set in the light path one of the plural color filters having a color of the printing light of which the light amount is to be adjusted.

The color photosensitive material is an instant photo film.

According to another aspect of the invention, an optical printer records a color image by exposing a color photosensitive material. The optical printer comprises a printing head, which includes a light source and a color separation filter unit. The color separation filter unit is disposed in a light path of light from the light source, for color separation of the light from the light source. The color separation filter unit includes plural color filters, arranged in a manner adjacent to one another in a plate shape, having selectivity of a wavelength, set in the light path sequentially, for converting the light from the light source into printing light of respectively single colors. At least one ND filter, disposed to lie on at least one of the plural color filters, for reducing the light amount of the printing light of at least one of the single colors.

The color photosensitive material extends two-dimensionally in a main scan direction and a sub scan direction, the color separation filter unit extends substantially parallel with the main scan direction, and the plural color filters are arranged in an arranging direction crosswise to the main scan direction. Furthermore, a filter sliding mechanism slides the color separation filter unit in the arranging direction.

The plural color filters are included in a single piece.

According to still another aspect of the invention, an optical printing method of recording a color image by exposing a color photosensitive material comprises the following steps. Light from a light source is converted into printing light of plural colors by filtering. A light amount of the printing light of the plural colors is controlled according to an image signal. The light amount of the printing light of at least one of the plural colors is reduced by filtering.

BRIEF DESCRIPTION OF THE DRAWINGS

The above objects and advantages of the present invention will become more apparent from the following detailed description when read in connection with the accompanying drawings, in which:

FIG. 4A illustrates a state in which a red color filter is in an entrance position, FIG. 4B illustrates a state in which a green color filter is in an exit position, FIG. 4C illustrates a state in which a blue color filter is in the entrance position, FIG. 4D illustrates a state in which the red color filter is in the exit position, FIG. 4E illustrates a state in which the green color filter is in the entrance position, FIG. 4F illustrates a state in which the blue color filter is in the exit position;

DETAILED DESCRIPTION OF THE PREFERRED EMBODIMENT(S) OF THE PRESENT INVENTION

Figure 1:
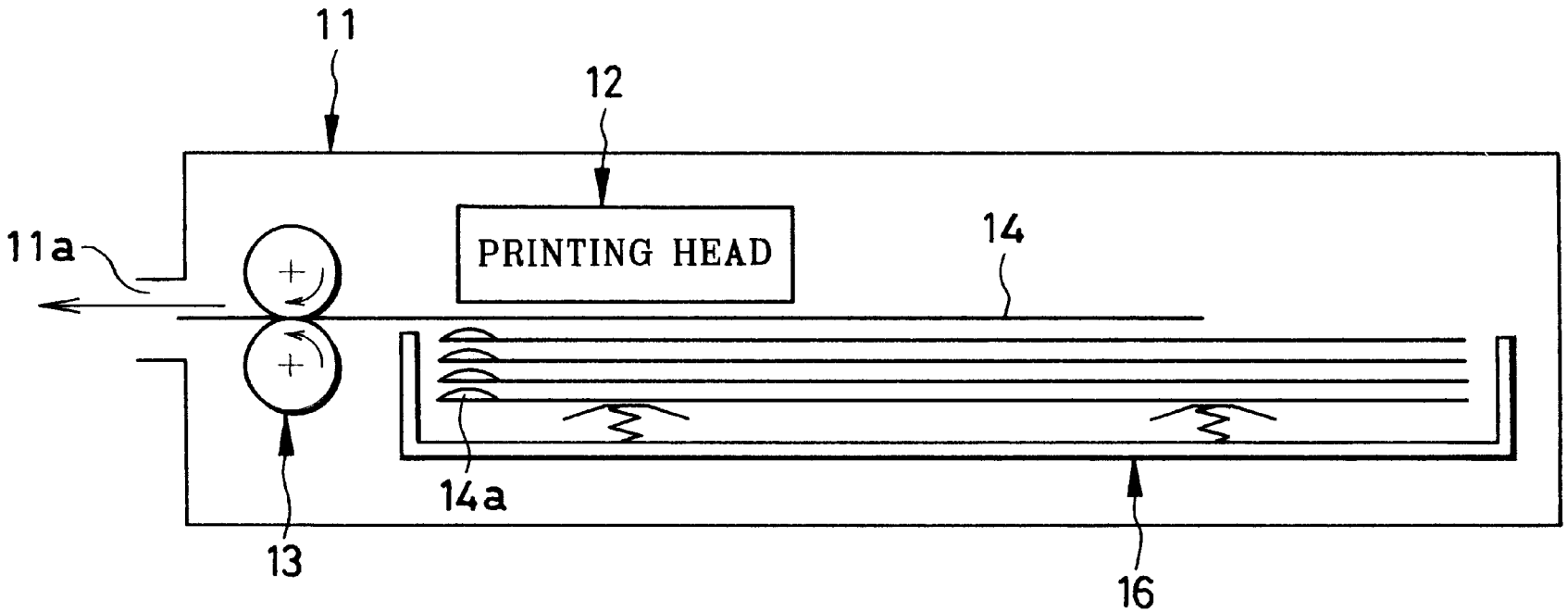
FIG. 1 is an explanatory view schematically illustrating an optical printer.

In FIG. 1, an optical printer 11 is depicted, and includes a printing head 12 and spreader rollers 13. The optical printer 11 is loaded with a cartridge 16 or instant photo film pack containing a stack of plural instant photo films 14 as color photosensitive material. The instant photo films 14 are a well-known mono-sheet type including red, green and blue sensitive layers overlaid on a support, and have a processing solution pod 14*a* for containing processing solution. After printing, the instant photo film 14 being exposed is squeezed by the spreader rollers 13 to break the processing solution pod 14*a*, from which the processing solution is spread to an exposure surface of the instant photo film 14. The instant photo film 14 is ejected through an exit slot 11*a* upon spreading of the processing solution. The instant photo film 14 after the ejection comes to have a positive image in the exposure surface at a lapse of one minute or a few minutes.

The printing head 12 records a color image by applying printing light of red, green and blue colors to the instant photo film 14. The printing head 12 has a length enough for one line of an image, and longitudinally extends in a main scan direction. The printing head 12 emits printing light of the red, green and blue colors for an exposure line by line. When color recording of one line is completed, the instant photo film 14 is fed by a feeder having a feeder motor 126 by an amount of one line, and is subjected to recording of the following line. Recording and feeding of one line are repeated to record a color image of one frame. An exposed portion of the instant photo film 14 is gradually advanced to the spreader rollers 13, and processed.

Figure 2:
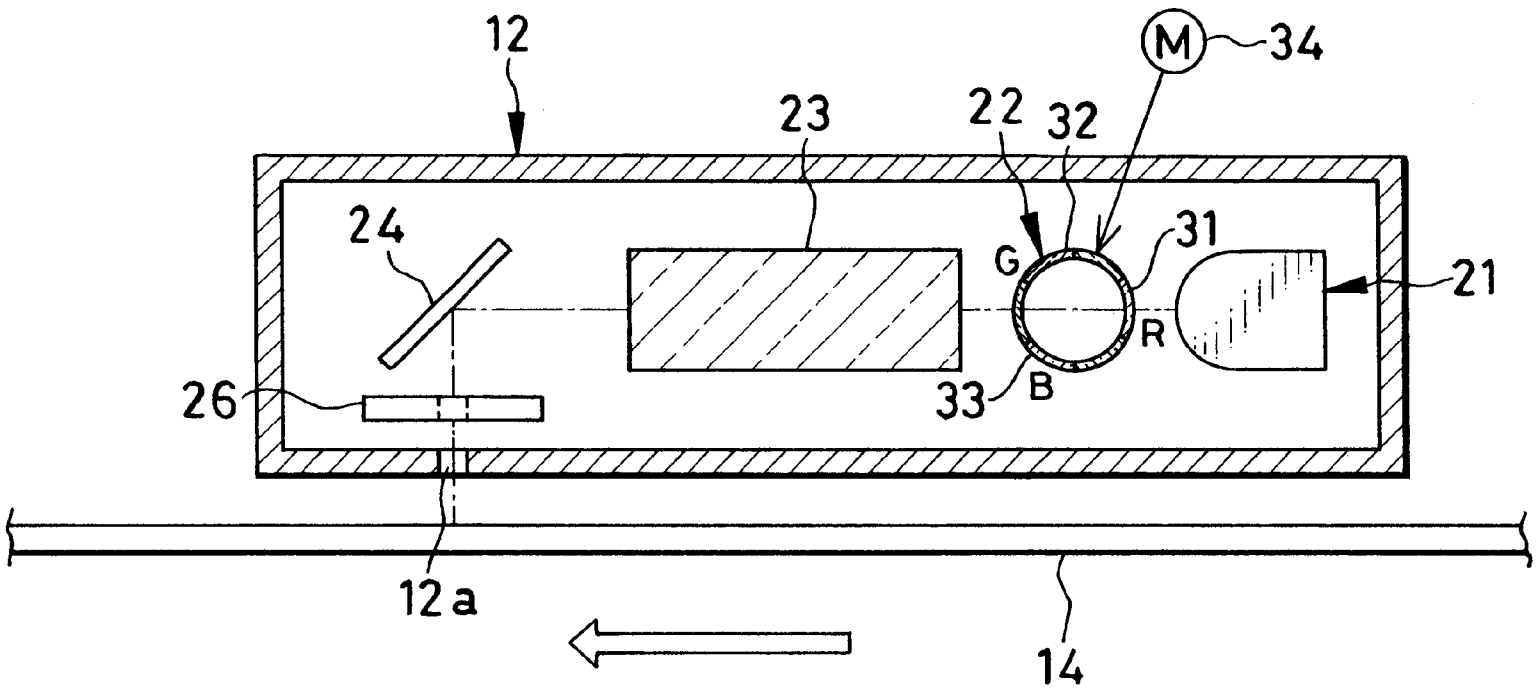
FIG. 2 is a vertical section illustrating a printing head with an instant photo film.
Figure 3A:
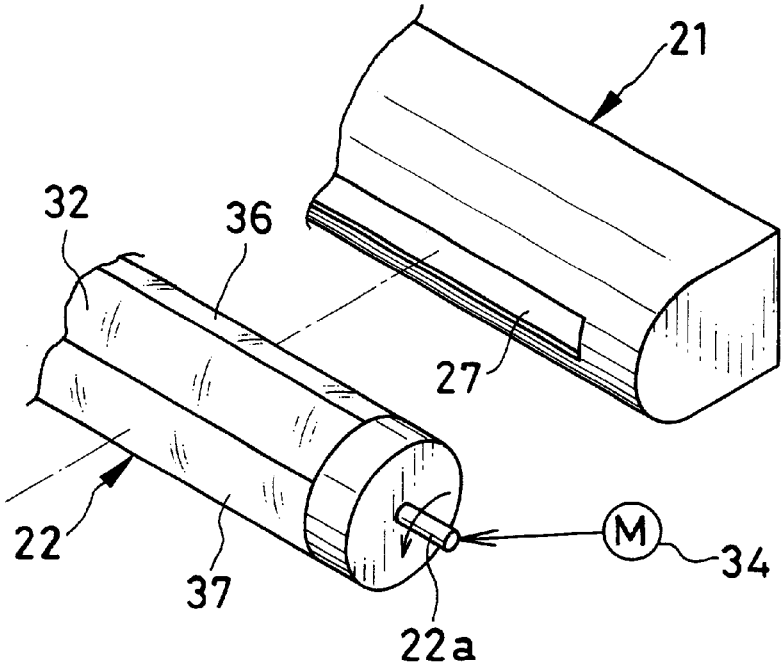
FIG. 3A is a perspective, partially broken, illustrating a color separation filter unit and a light source.
Figure 3B:
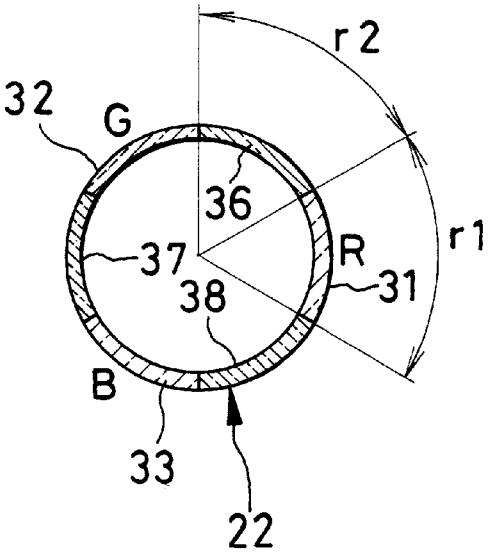
FIG. 3B is a cross section illustrating the color separation filter unit.

In FIG. 2, 3A and 3B, the printing head 12 is a combination of a light source 21, a color separation filter unit 22, a SELFOC lens array 23, a reflector 24 and a liquid crystal display (LCD) micro shutter 26 included in a light amount adjustor. Light emitted directly by the light source 21 is passed through the color separation filter unit 22 and separated into printing light of any one of the blue, green and red colors. The printing light passes the SELFOC lens array 23, the reflector 24, the LCD micro shutter 26 and an opening 12*a* and is applied to the instant photo film 14 for exposure.

The light source 21 is constituted by a light-emitting element 27 for emitting white light. An example of the light-emitting element 27 is a light-emitting diode. The light-emitting element 27 has a length of one line. Note that light from the light-emitting element 27 may be what has a color different from white but includes light of the red, green and blue colors. Also, a fluorescent lamp or other suitable light source may be used instead of the light-emitting element.

The LCD micro shutter 26 consists of an array of plural liquid crystal display (LCD) segments, each of which corresponds to one pixel. The LCD micro shutter 26 is controllable for changes in transmittance per each of the LCD segments, and adjusts an amount of the printing light passed through or blocks the printing light. The LCD segments are controlled according to an image signal.

The SELFOC lens array 23 includes a great number of SELFOC lenses arranged in one train for converging light at one point. The number of the SELFOC lenses is that of pixels. The SELFOC lens array 23 produces printing light by each pixel, and prevents the light from being spread to positions of adjacent pixels. Note that light-shielding members are disposed in the case in a suitable manner, and cause printing light to exit from the opening 12*a*.

The color separation filter unit 22 has a tubular shape, and has a central axis 22*a* extending perpendicularly to a light path. The color separation filter unit 22 is supported in a rotatable manner about the central axis 22*a*. A peripheral surface of the color separation filter unit 22 is equally divided about the central axis 22*a*, and is provided with red, green and blue color filters 31, 32 and 33 and transparent plates 36, 37 and 38 or transmission portions. The color filters 31–33 have selectivity of the wavelength, and converts white light into printing light of each one color. The transparent plates 36–38 do not have selectivity of the wavelength, and allows light to pass without a change. A filter drive motor 34 drives the color separation filter unit 22 to rotate. When the color separation filter unit 22 rotates, the color filters 31–33 are inserted into the light path selectively.

The peripheral face of the color separation filter unit 22 is divided into six portions to dispose the color filters 31–33 and the transparent plates 36–38 alternately. In other words, the transparent plates 36–38 are opposed to respectively the color filters 31–33. An entrance position is defined as a position where light from the light source 21 enters the color separation filter unit 22. An exit position is defined as a position where the light exits from the color separation filter unit 22. When each of the color filters 31–33 is located in the entrance position, one of the transparent plates 36–38 is located in the exit position. Also, when each of the color filters 31–33 is located in the exit position, one of the transparent plates 36–38 is located in the entrance position. As a result, light passing through the color separation filter unit 22 passes only one of the color filters 31–33 for the red, green and blue colors. The light from the light source 21 is converted by the color separation filter unit 22 into printing light of one of the red, green and blue colors.

Let r1 be a central angle of each of the color filters 31–33. Let r2 be a central angle of each of the transparent plates 36–38. The central angles r1 and r2 are approximately 60 degrees for the color filters 31–33 and the transparent plates 36–38 to have an equal size. The central angles r1 and r2 are determined according to the total number of the color filters 31–33 and the transparent plates 36–38. It is to be noted that the central angle r2 may not be equal to the central-angle r1. For example, it is possible that r1<r2.

Note that, in the present embodiment, the color filters 31–33 and the transparent plates 36–38 are originally separate pieces assembled and fixed by use of a pair of caps or rings fitted to their ends. Alternatively, it is possible to produce the color filters 31–33 and the transparent plates 36–38 from a single sheet. At first, a transparent sheet is wound into a cylindrical shape, on which three colors are printed in three portions of a rectangular shape. Then a pair of caps or rings are fitted on ends of the cylindrical sheet.

A preferable example of material for producing the color filters 31–33 and the transparent plates 36–38 is a plastic film, sheet or plate. For the colors of the color filters 31–33, the film, sheet or plate may be coated with suitably selected pigment, dye or any coloring material. Also, film, sheet or plate may be glass or the like.

Figure 3C:
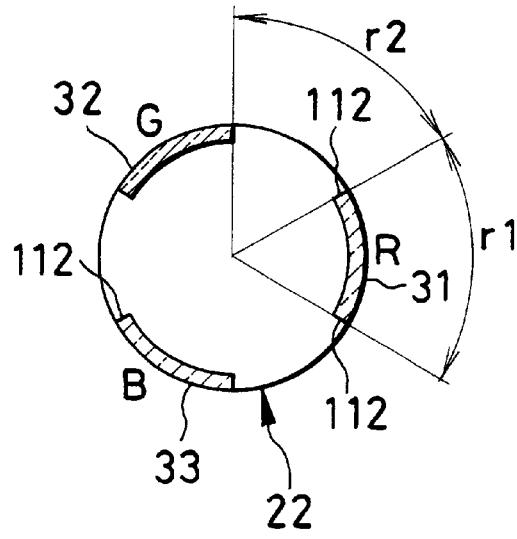
FIG. 3C is a cross section illustrating another color separation filter unit having openings.

All the periphery of the color separation filter unit 22 is constituted by the combination of the color filters 31–33 and the transparent plates 36–38, and does not have an opening. Thus, there is little resistance of air to the color separation filter unit 22 during rotation. There occurs little noise in the rotation. Note that openings 112 in FIG. 3C can be formed instead of the transparent plates 36–38 for passage of light. This is effective in reducing the cost as the transparent plates 36–38 are not used.

Note that, in the present embodiment, the color filters 31–33 are originally separate pieces assembled and fixed by use of a pair of caps or rings fitted to their ends, to result in forming the openings 112 defined between the color filters 31–33. Alternatively, it is possible to produce the color filters 31–33 in a single sheet being transparent or of a certain color. To be precise, three colors are printed on a flat sheet in three portions of a rectangular shape. Then the openings 112 are formed by cutting operation between the colored portions. The sheet is wound cylindrically, and provided with a pair of caps or rings on its ends.

Figure 4A:
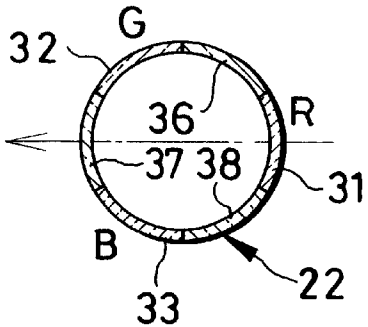
FIGS. 4A–4F are cross sections illustrating the color separation filter unit of FIGS. 3A and 3B at six phase angles in sequence, where

In FIGS. 4A–4F, an image of one line is exposed in a sequence of red, green and blue during rotation of the color separation filter unit 22. Each time that the color separation filter unit 22 makes one rotation, two lines are recorded. In FIG. 4A, the red color filter 31 is set in an entrance position, which is defined as a position of entry of light from the light source 21 into the color separation filter unit 22. The light from the light source 21 is passed through the red color filter 31 to become red printing light, which passes the transparent plate 37 set in an exit position, which is defined as a position of exit of the light from the color separation filter unit 22.

Figure 4B:
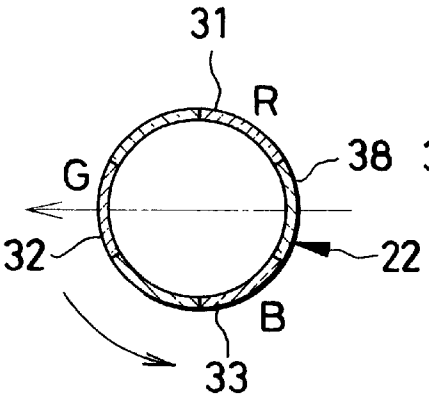
Figure 4C:
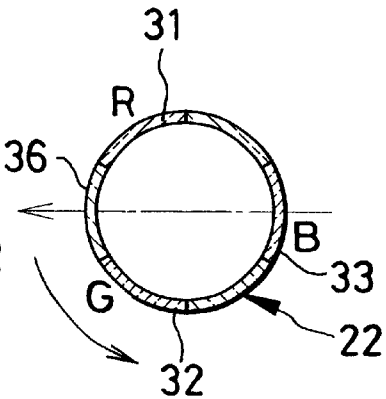
Figure 4D:
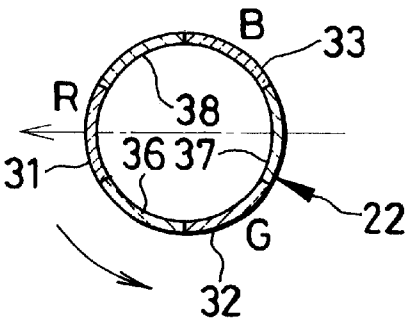
Figure 4E:
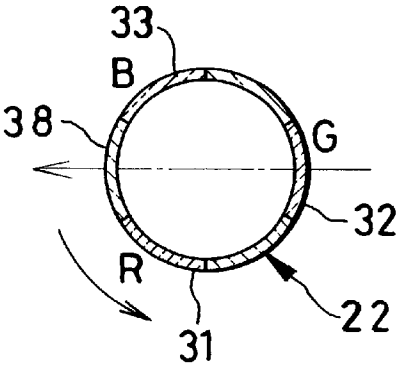
Figure 4F:
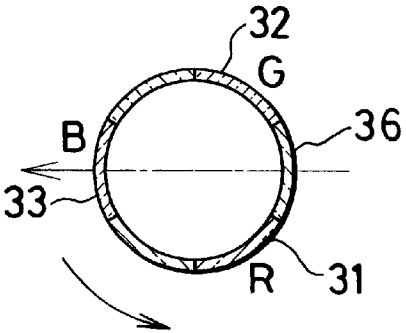

When the color separation filter unit 22 is rotated in the counterclockwise direction by 60 degrees, the green color filter 32 is inserted in the light path. In FIG. 4B, the green color filter 32 is disposed in the exit position. Light from the light source 21 enters the color separation filter unit 22 through the transparent plate 38, and passes the green color filter 32 to exit from the color separation filter unit 22. The light becomes green printing light upon passage through the green color filter 32. In FIG. 4C, the color separation filter unit 22 rotates further by 60 degrees, to set the blue color filter 33 in the entrance position. Light from the light source 21 enters the color separation filter unit 22 through the blue color filter 33, becomes blue printing light, and passes the transparent plate 36 to exit from the color separation filter unit 22. Consequently printing light of the red, green and blue colors operates for an exposure, to record an image of one line. In FIGS. 4D, 4E and 4F, the color separation filter unit 22 further makes half a rotation, while another line is recorded. In this half rotation, the color filters 31–33 are inserted in the light path in a different manner related to the entrance position and exit position.

In the present embodiment, the peripheral face of the color separation filter unit 22 is divided into the six having the color filters 31–33 and the transparent plates 36–38. However, the peripheral face of the color separation filter unit 22 may be divided into a number 6(2n+1) of portions, where n is an integer equal to or more than zero (0).

Figure 5:
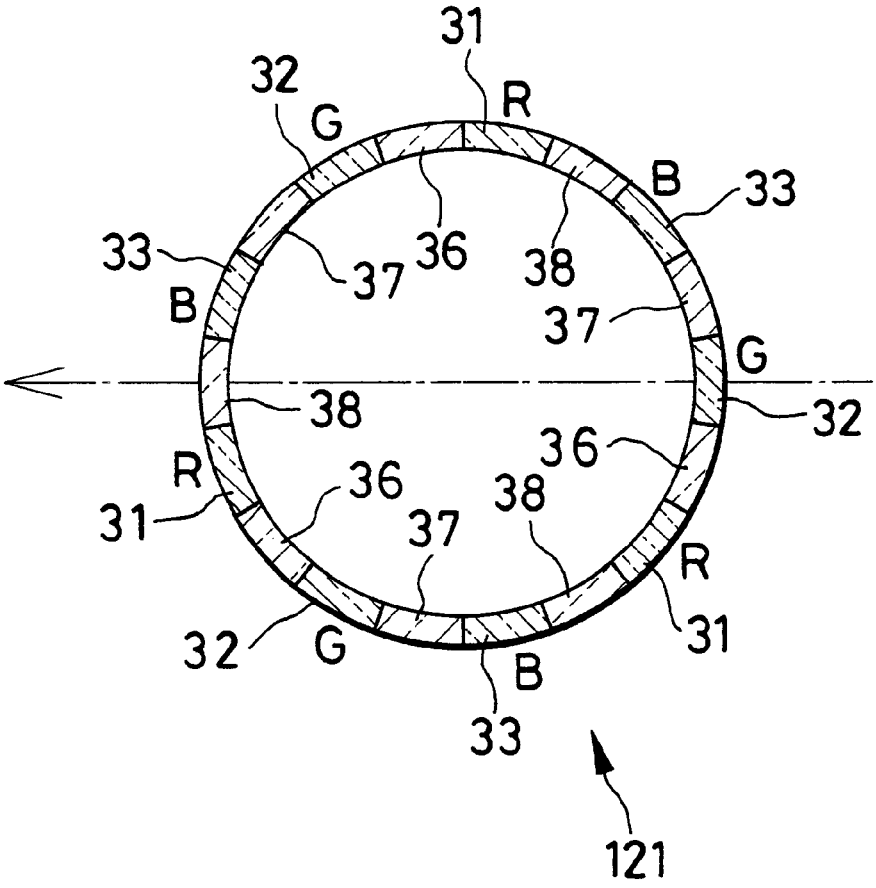
FIG. 5 is a cross section illustrating another color separation filter unit with nine color filters.

In FIG. 5, another preferred color separation filter unit 121 is depicted, in which the periphery is divided into 18 portions (n=1). The color separation filter unit 121 has the three red color filters 31, the three green color filters 32, the three blue color filters 33 and the nine transparent plates 36, 37 and 38. While the color separation filter unit 121 makes one rotations, six lines are recorded.

Figure 6:
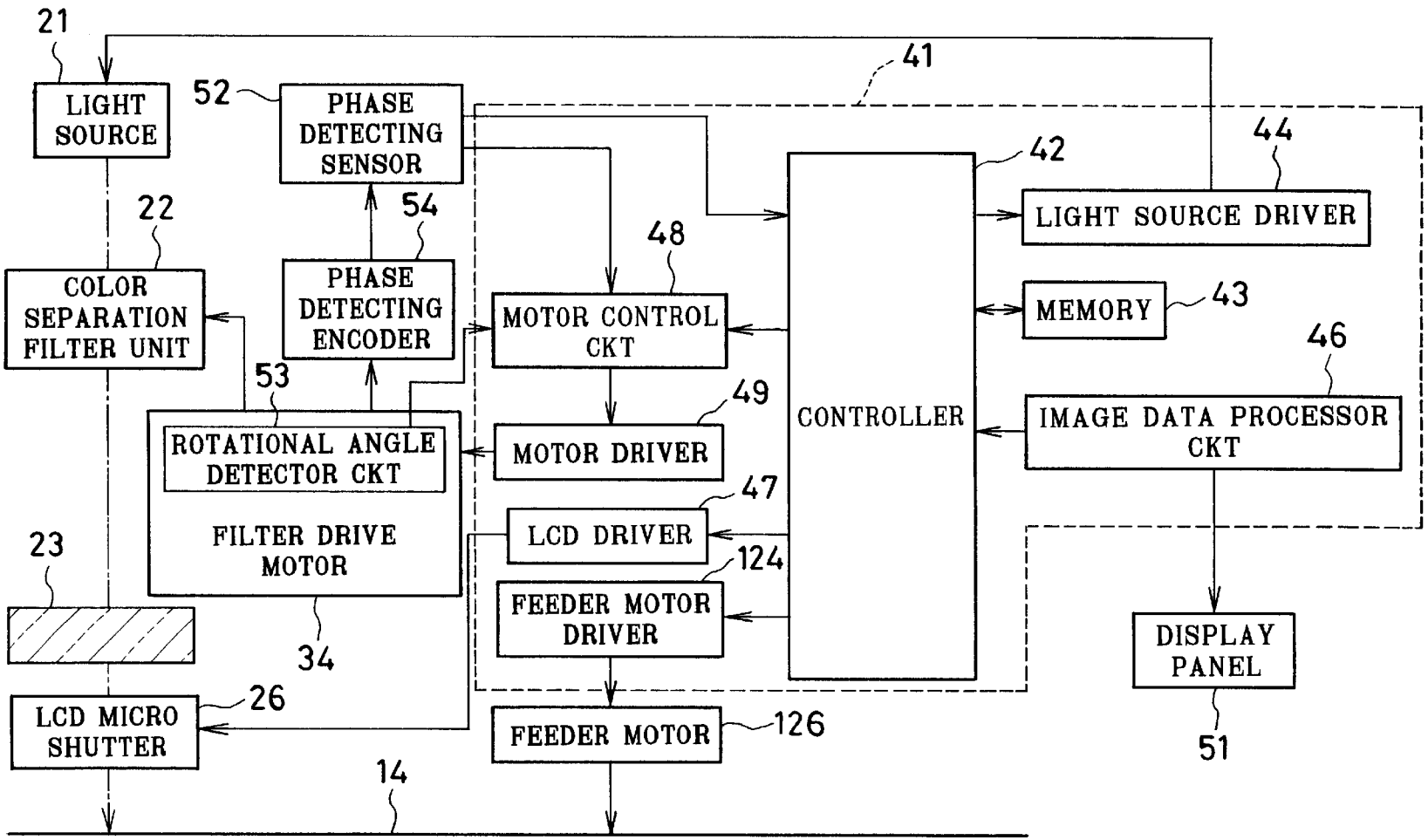
FIG. 6 is a block diagram schematically illustrating circuits in the optical printer of FIG. 1.

In FIG. 6, a control unit 41 controls the printing head 12. The control unit 41 is constituted by a controller 42, a memory 43, a light source driver 44, an image data processor circuit 46, an LCD driver 47, a motor control circuit 48, a motor driver 49 and a feeder motor driver 124 included in a feeder. The light source driver 44 drives the light source 21 according to a control signal from the controller 42. The image data processor circuit 46 converts image data from the memory 43 to an image signal, which is sent to the LCD driver 47. Also, a display panel 51 of the printer is driven by the image data processor circuit 46 to display a simulated image to be printed.

According to the image signal, the LCD driver 47 drives the LCD micro shutter 26 by each LCD segment. Transmittance of each LCD segment changes to control intensity of printing light. Timing of driving the LCD micro shutter 26 is synchronized with the phase of the color separation filter unit 22 by means of a timing signal output by a phase detecting sensor 52.

The feeder motor 126 is driven by the feeder motor driver 124. The feeder motor 126 operates to feed the instant photo film 14, and consists of a stepping motor. The feeder motor driver 124 sends a drive pulse to the feeder motor 126 upon receiving a detection signal from the phase detecting sensor 52. Thus, the feeder motor 126 is synchronized with the phase of the color separation filter unit 22. Each time that the color separation filter unit 22 makes half a rotation, the instant photo film 14 is fed by one line.

The filter drive motor 34 is a DC servo motor, and is driven by a driving voltage applied by the motor driver 49. A rotating amount of the filter drive motor 34 is controlled by the driving voltage. The rotating speed and phase of the filter drive motor 34 is controlled by the motor control circuit 48. A rotational angle detector circuit 53 is incorporated in the filter drive motor 34, and sends a signal to the motor control circuit 48 to control the number of rotations.

Figure 7:
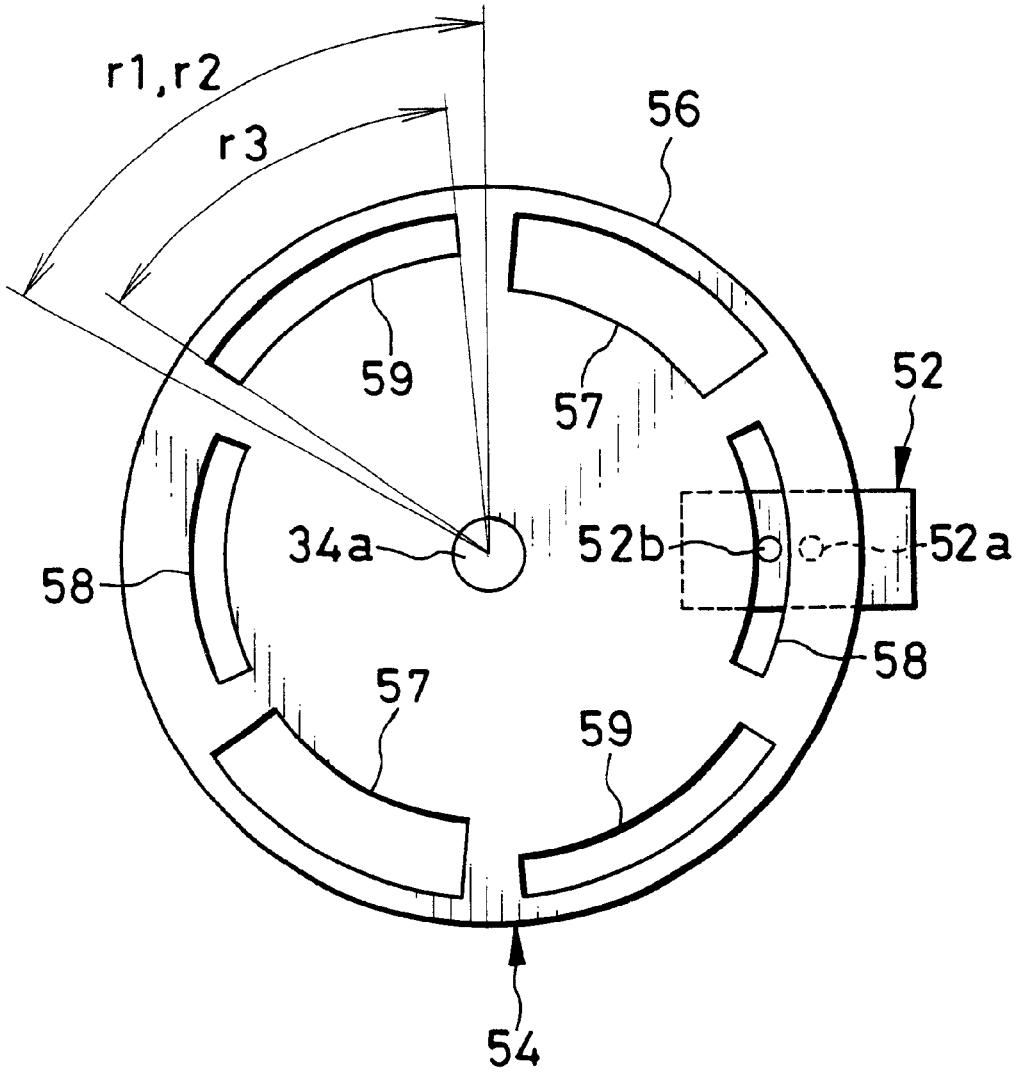
FIG. 7 is a side elevation illustrating an encoder disk for use with the color separation filter unit.

In FIG. 7, a phase detecting encoder 54 includes an encoder disk 56 provided with slits 57, 58 and 59. The slits 57–59 are color information having discernability and operate for detecting the phase of the color separation filter unit 22. An output shaft 34*a* of the filter drive motor 34 as a central axis is provided with the phase detecting encoder 54 secured thereto, so the phase detecting encoder 54 rotates with the filter drive motor 34. The color separation filter unit 22 is directly connected with the filter drive motor 34, and rotates at the same rotational speed as the latter.

The slit 57 is formed in a manner corresponding to the red color filter 31 and the transparent plate 37 opposed to the red color filter 31. Similarly, the slit 58 is formed in a manner corresponding to the green color filter 32 and the transparent plate 38 opposed to the green color filter 32. The slit 59 is formed in a manner corresponding to the blue color filter 33 and the transparent plate 36 opposed to the blue color filter 33. The slits 57–59 are provided with different widths and positions in a radial direction for discernment by means of the phase detecting sensor 52.

The phase detecting sensor 52 consists of a photo interrupter, and includes a light source and two photo receptors 52*a* and 52*b* for receiving light from the light source. The photo receptors 52*a* and 52*b* discern the slits 57–59. The phase detecting sensor 52 is secured to a position for detecting each one of the slits 57–59 corresponding to an inserted one of the color filters 31–33 upon insertion into the light path.

When the slit 57 for the red color filter 31 passes the phase detecting sensor 52, both of the photo receptors 52*a* and 52*b* receives light from a light source. When the slit 58 for the green color filter 32 passes the phase detecting sensor 52, light to the photo receptor 52*a* is blocked. The photo receptor 52*b* receives light. When the slit 59 for the blue color filter 33 passes the phase detecting sensor 52, light to the photo receptor 52*b* is blocked. The photo receptor 52*a* receives light. Thus, one of the color filters 31–33 set in the light path is recognized. The phase of the color separation filter unit 22 is detected.

While the phase detecting sensor 52 generates the phase detecting signal, the LCD micro shutter 26 is driven according to an image signal for each color of the color filters 31–33 being inserted. Note that time during which the phase detecting sensor 52 generates the phase detecting signal is determined according to the angle r3 of the range of the slits 57–59. The angle r3 of the slits 57–59 is approximately 50 degrees, and smaller than the angles r1 and r2 of the ranges of the color filters 31–33 and the transparent plates 36–38.

After rotation of the color separation filter unit 22 inserts one of the color filters in the light path, the LCD micro shutter 26 starts being driven upon an image signal of the color of the one color filter. Before the entirety of the one color filter is moves away from the light path, outputting the image signal is completed to discontinue the driving of the LCD micro shutter 26. Thus, no mixture in the color occurs, because the color of the color filters is exactly set as the color of the image signal sent to the LCD driver 47 at the time of changing over the color filters.

Figure 8:
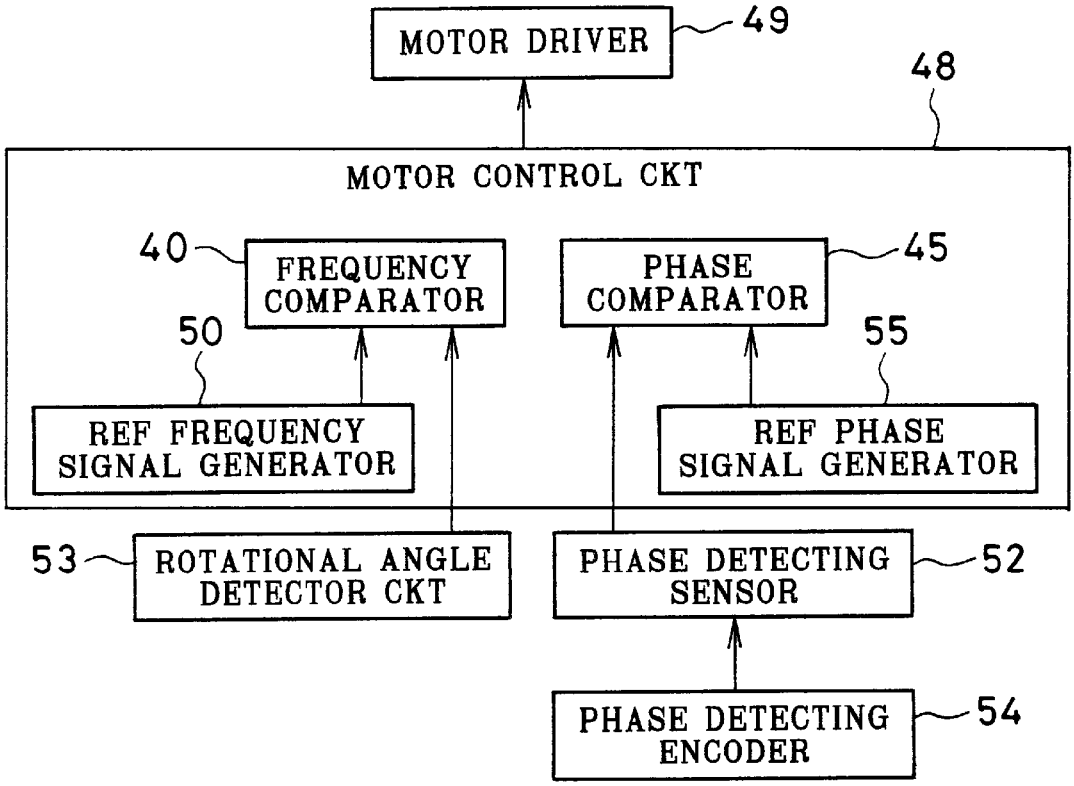
FIG. 8 is a block diagram schematically illustrating a motor control circuit with relevant circuits.
Figure 9A:
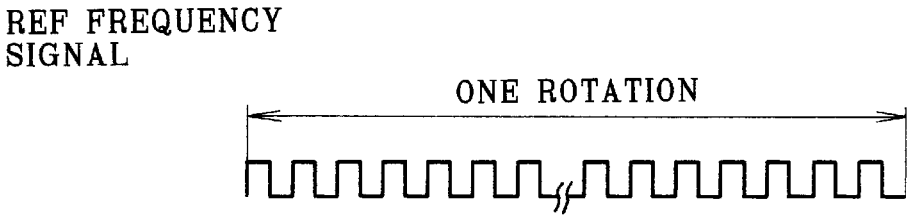
FIGS. 9A and 9B are timing charts illustrating waveforms of respectively a reference frequency signal and a reference phase signal.

In FIG. 8, the motor control circuit 48 includes a frequency comparator 40, a phase comparator 45, a reference frequency signal generator 50 and a reference phase signal generator 55. As illustrated in FIG. 9A, the reference frequency signal generator 50 generates a reference pulse of a regular width at a regular period. The number of reference pulses generated while the color separation filter unit 22 makes one rotation is predetermined. The number of the reference pulses is compared by the frequency comparator 40 with the pulse number output by the rotational angle detector circuit 53, to keep constant the rotational speed of the filter drive motor 34.

Figure 9B:
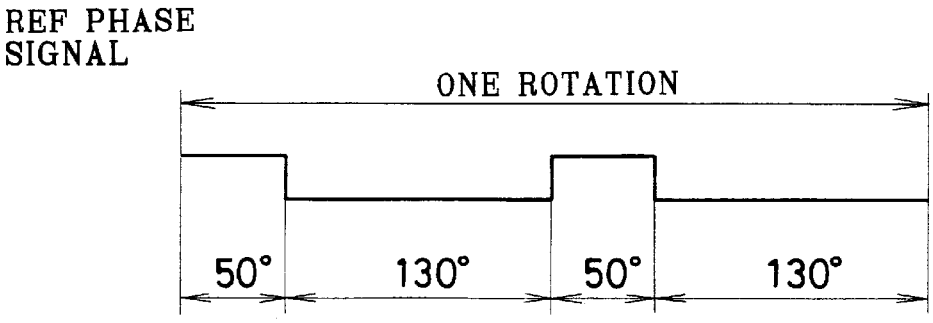

As depicted in FIG. 9B, the reference phase signal generator 55 generates a reference phase pulse having a width of the angle of the slits 57–59 or approximately 50 degrees. While the color separation filter unit 22 makes one rotation, the reference phase signal generator 55 generates two reference phase pulses. A pulse output by the phase detecting sensor 52 is compared with the reference phase pulse by the phase comparator 45, to control the phase of the color separation filter unit 22. Thus, the color of the image signal to be sent to the LCD driver 47 is caused by synchronization to coincide with the colors of the color filters 31–33 to be inserted in the light path.

Figure 10A:
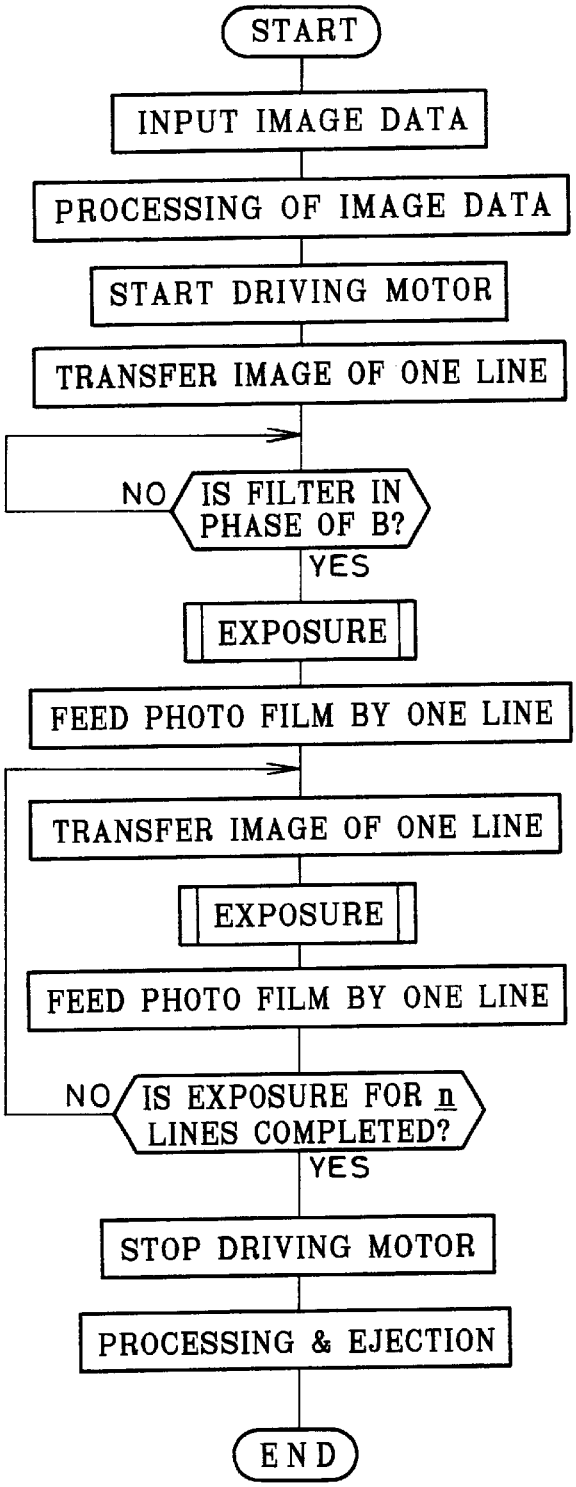
FIGS. 10A and 10B are flow charts illustrating a printing operation.
Figure 10B:
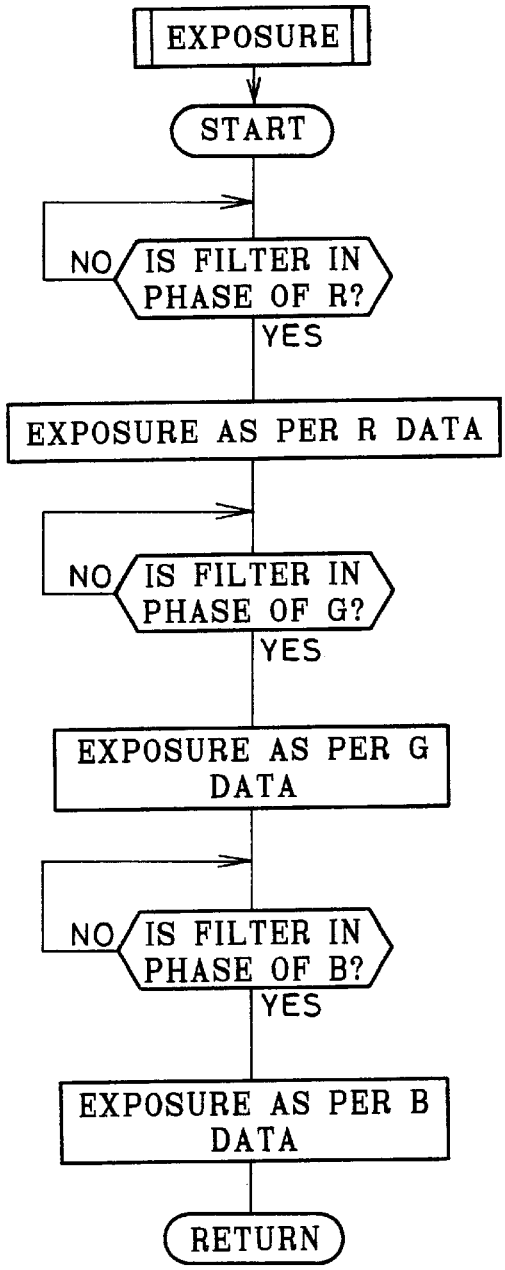

The operation of the above embodiment is described with reference to flow charts of FIGS. 10A and 10B. At first, the cartridge 16 is set. A command signal for printing is input. Image data is read from the memory 43, and is converted to an image signal by the image data processor circuit 46. At the same time, the filter drive motor 34 is actuated to rotate the color separation filter unit 22. With the start of driving the filter drive motor 34, the reference frequency signal generator 50 operates to control the rotational speed.

An image signal of a first line is transferred to the LCD driver 47. A phase detecting signal is sent by the phase detecting sensor 52 to the LCD driver 47. When the phase detecting sensor 52 detects the slit 59 for the blue color filter 33, an exposure of the one first line is started.

When the phase detecting sensor 52 detects the slit 57, the LCD micro shutter 26 is driven according to the red image signal. Light emitted directly by the light source 21 passes the red color filter 31 to become red printing light, which passes the LCD micro shutter 26 to expose the instant photo film 14. Exposure continues while the phase detecting sensor 52 detects the slit 57.

The color separation filter unit 22 rotates to move the red color filter 31 away from the light path. Instead, the green color filter 32 is set in the light path. When the phase detecting sensor 52 detects the slit 58, the LCD micro shutter 26 is driven according to the green image signal. The angle r3 of the slits 57–59 is predetermined smaller than the angles r1 and r2 of the color filters 31–33 and the transparent plates 36–38. Shortly after setting the green color filter 32 in the light path, the slit 58 is detected to start driving the LCD micro shutter 26. Thus, no mixture in the colors occurs. Light from the light source 21 passes the green color filter 32 to become green printing light, which passes the LCD micro shutter 26 to come incident upon the instant photo film 14. Exposure of the instant photo film 14 continues while the phase detecting sensor 52 detects the slit 58.

Furthermore, the color separation filter unit 22 rotates to set the blue color filter 33 in the light path. Upon detection of the slit 59, the LCD micro shutter 26 is driven according to the blue image signal. Blue printing light passes the LCD micro shutter 26 to expose the instant photo film 14.

When the exposure of one line is completed, the mechanism with the feeder motor 126 feeds the instant photo film 14 by the line. Then another line starts being exposed. When the exposure of the two lines is completed, the color separation filter unit 22 is caused to make one rotation. Similarly, line images are recorded line after line, until an image of a frame is recorded. During feeding of the instant photo film 14, the spreader rollers 13 squeeze the processing solution pod 14*a*. An exposed portion of the instant photo film 14 is subjected to processing by spreading of processing solution to an exposure surface. When the exposure of the frame is completed, the instant photo film 14 is exited from the optical printer 11.

In the above embodiments, the LCD segments in the LCD micro shutter 26 are controlled for transmittance. Furthermore, it is possible to control the LCD segments in the LCD micro shutter 26 time-sequentially for changing light amounts for pixels. To be precise, a pixel to be recorded with a middle density is exposed with a controlled middle light amount by keeping open the LCD segment during time shorter than a full time length that is predetermined for recording the highest density.

Figure 11:
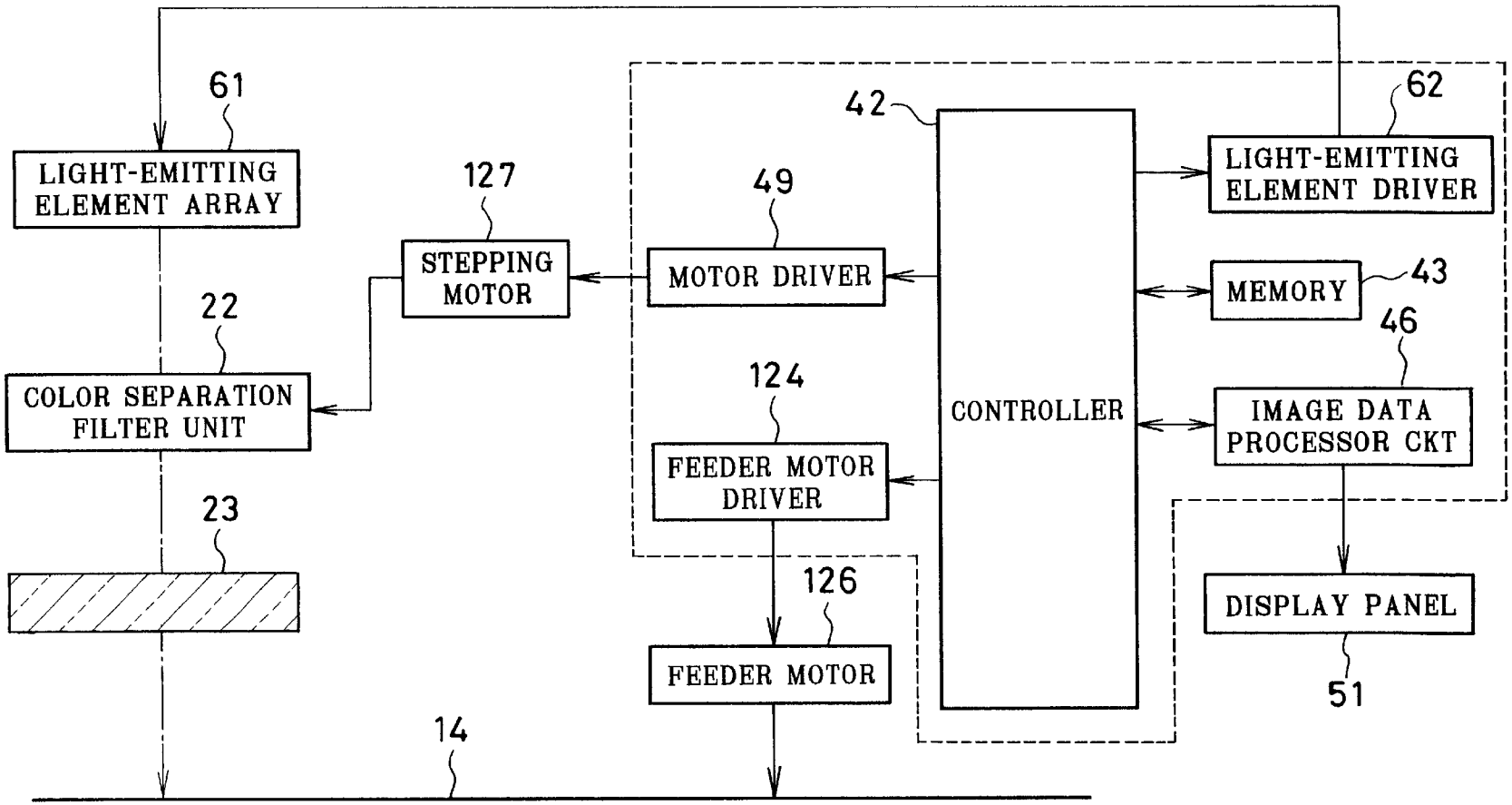
FIG. 11 is a block diagram schematically illustrating another preferred optical printer with a stepping motor in a printing head.
Figure 12:
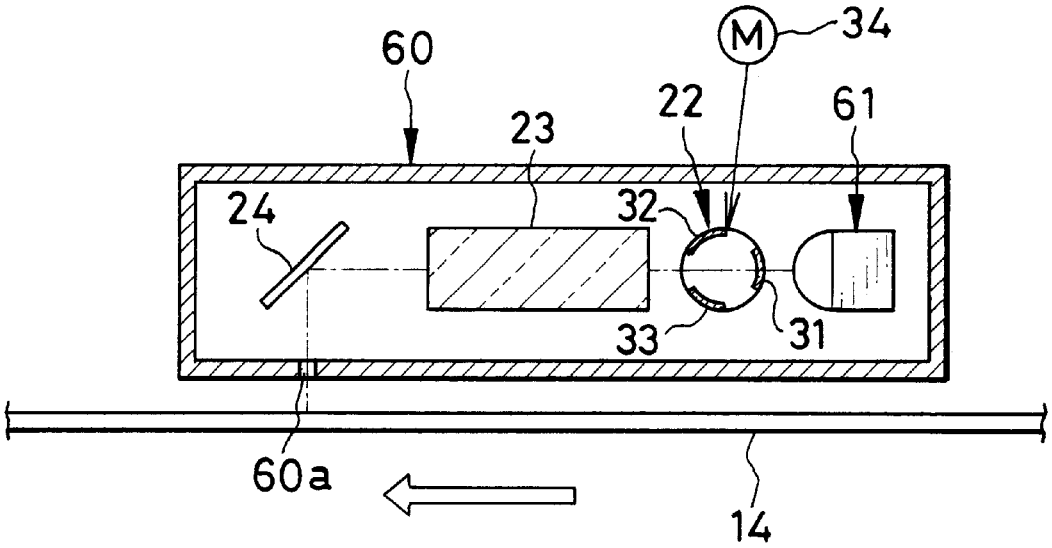
FIG. 12 is a vertical section illustrating a printing head in the optical printer of FIG. 11.

In FIGS. 11 and 12, another preferred embodiment is depicted, in which a light-emitting element array 61 as light source is incorporated in a printing head 60. The light-emitting element array 61 includes light-emitting elements in a number enough for the number of pixels. The light-emitting element array 61 is driven by a light-emitting element driver 62, and controlled for intensity of light to emit, the light-emitting element driver 62 constituting a light amount adjustor. The light from the light-emitting element array 61 passes the color separation filter unit 22 and becomes printing light of any of the red, green and blue colors, and then passes the SELFOC lens array 23 to come incident upon the instant photo film 14. The use of the light-emitting element array 61 is advantageous as the LCD micro shutter is unnecessary to reduce the number of the parts.

In the present embodiment, a stepping motor 127 instead of a DC servo motor is incorporated as a filter drive mechanism for driving the color separation filter unit 22. The phase of the color separation filter unit 22 can be controlled by drive pulses. This is advantageous as no control circuit is required for the motor.

Figure 13:
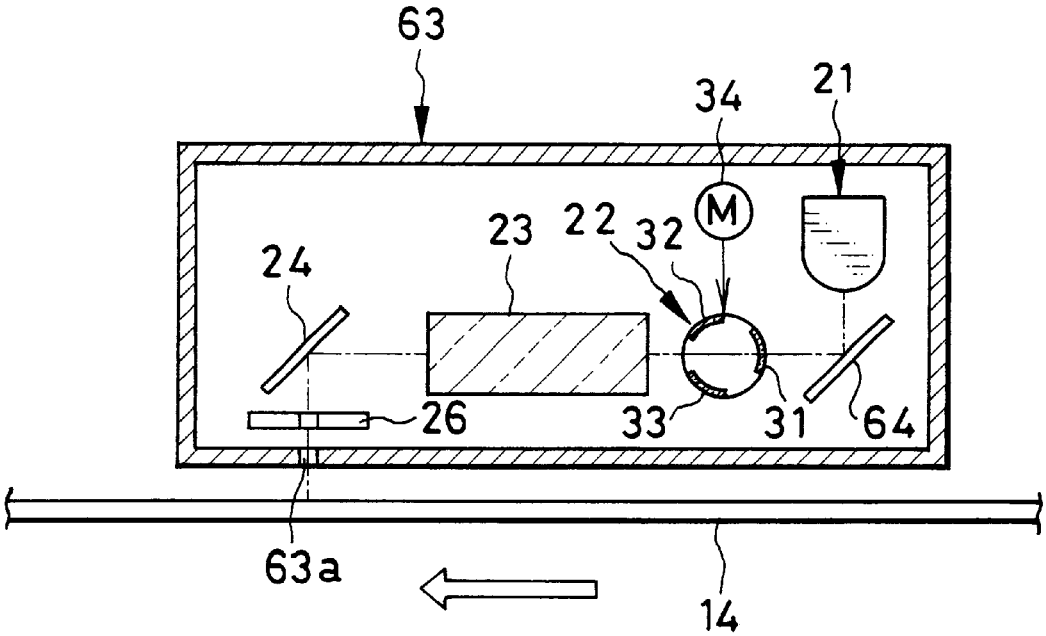
FIG. 13 is a vertical section illustrating another printing head with a reflector between a color separation filter unit and a light source.
Figure 14A:
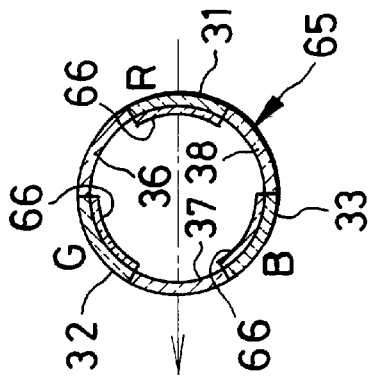
FIGS. 14A–14F are cross sections illustrating another color separation filter unit with ND filters behind the color filters.
Figure 14B:
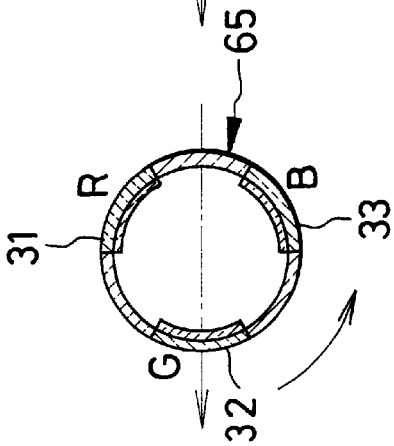
Figure 14C:
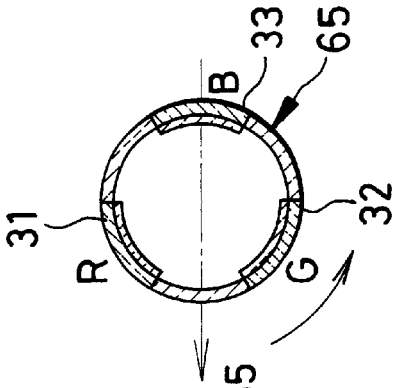
Figure 14D:
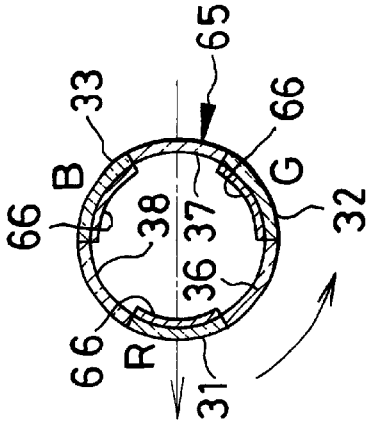
Figure 14E:
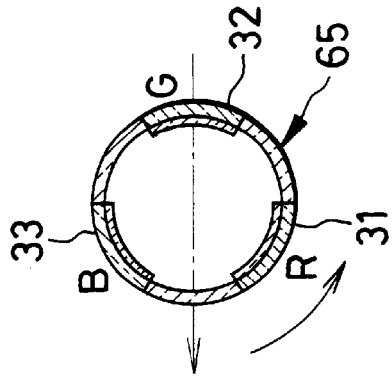
Figure 14F:
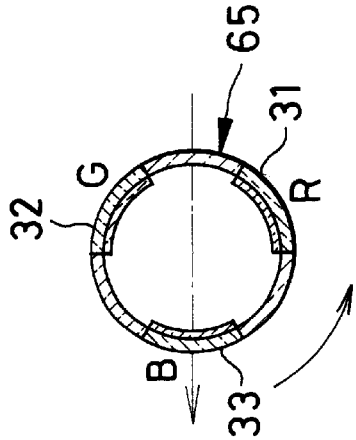

In FIG. 13, another preferred printing head 63 is illustrated, in which the light source 21 is directed downwards. A reflector 64 is disposed in the light path, and makes it possible to dispose the light source 21 in a suitable orientation. It is to be noted that the positions of the SELFOC lens array 23 and the color separation filter unit 22 may be changed to each other.

In FIGS. 14A–14F, another preferred color separation filter unit 65 is depicted, in which ND filters 66 are incorporated for reducing a light amount. The ND filters 66 are attached to respectively the color filters 31–33. Accordingly, the exposure amount is adjusted to regularize density of the blue, green and red colors even though the relative sensitivity of the blue, green and red sensitive layers is different in the instant photo film 14.

Figure 15A:
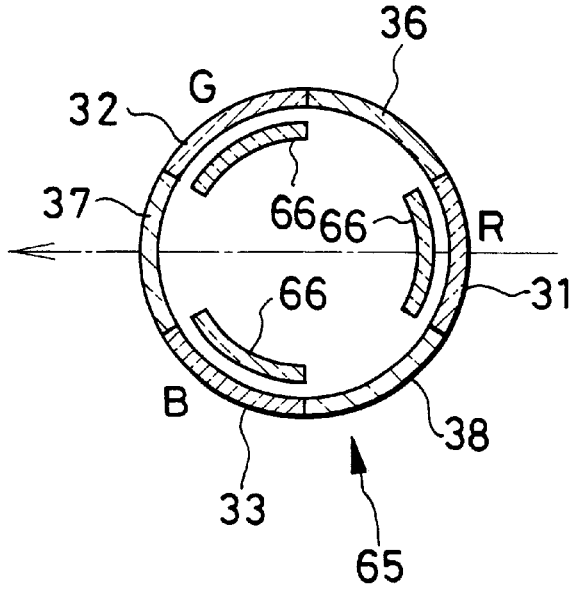
FIG. 15A is a cross section illustrating a color separation filter unit having an ND filter with a space behind each color filter.
Figure 15B:
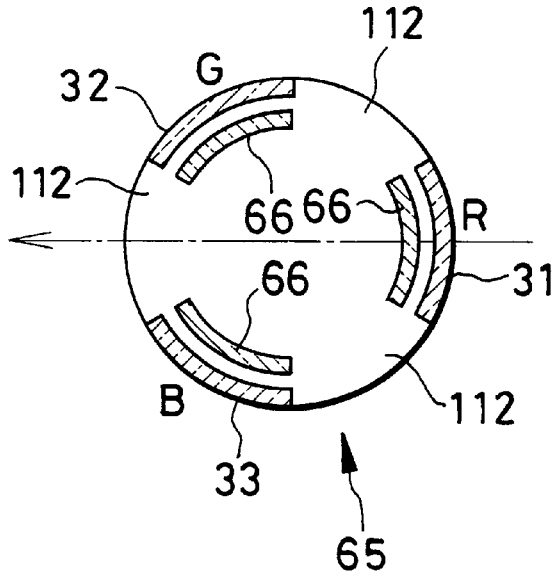
FIG. 15B is a cross section illustrating a color separation filter unit similar to that of FIG. 15A but having the openings.
Figure 16A:
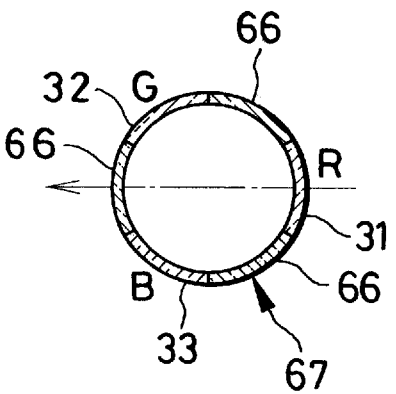
FIGS. 16A–16F are cross sections illustrating another color separation filter unit with ND filters between the color filters.
Figure 16B:
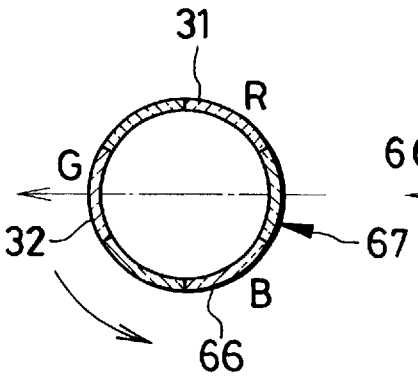
Figure 16C:
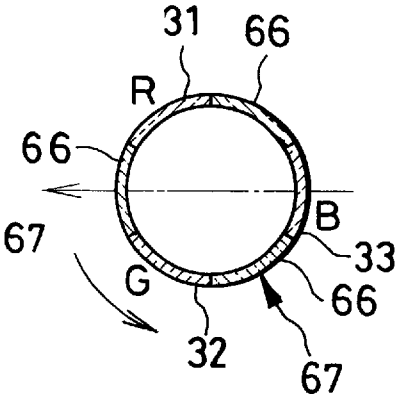
Figure 16D:
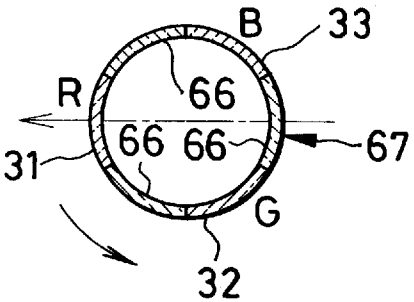
Figure 16E:
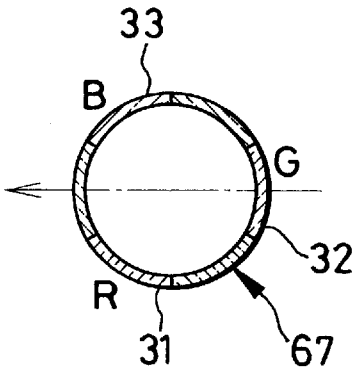
Figure 16F:
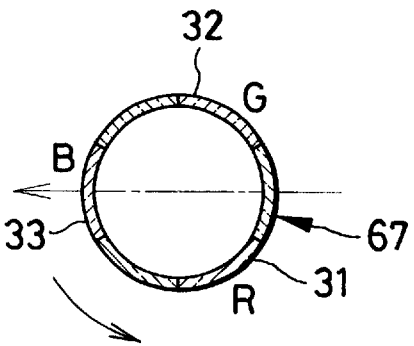

Note that the ND filters 66 may be attached to an outer face of the color filters 31–33. In FIG. 15A, an embodiment is illustrated in which the ND filters 66 are disposed behind the color filters 31–33 with a space without direct contact. In FIG. 15B, an embodiment is illustrated in which the openings 112 are formed instead of the transparent plates 36–38 for transmission of light.

In the above embodiments, all the color filters 31–33 are provided with the ND filters 66. However, the ND filters 66 may be attached to filters of only one or two colors selected from the color filters 31–33, to reduce light amounts of only the one or two colors. Thus, differences in the density between three colors can be compensated for by means of the ND filters 66 easily in connection with the photo film, color separation filter unit and light source.

If there are differences between relative photo sensitivity of photosensitive layers of the instant photo film 14, it is possible to use ND filters only for color filters of the color of a photosensitive layer with higher relative photo sensitivity. The light amount of the same color can be reduced exclusively. Thus, density of the three colors can be well-balanced. Also, if there are differences in transmittance of the color filters 31–33, it is possible to use ND filters only for color filters with higher transmittance. Thus, density of the three colors can be well-balanced. Furthermore, if there are differences in brightness in spectral distribution of the light source, it is possible to use ND filters only for color filters of the color with higher spectral brightness. Thus, density of the three colors can be well-balanced.

However, it is preferable in a color separation filter unit to have a transparent filter or transparent plate without reduction of a light amount if the filter unit does not have the ND filters 66. This is in consideration of balance of the weight of the color separation filter unit.

Figure 17A:
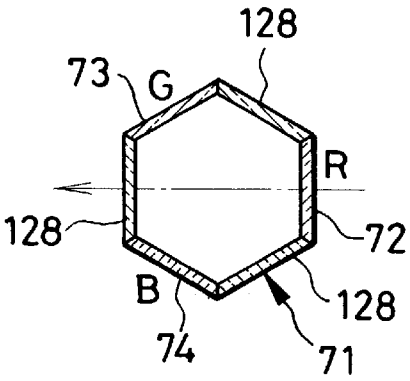
FIGS. 17A–17F are cross sections illustrating another color separation filter unit in a shape of a hexagonal prism.
Figure 17B:
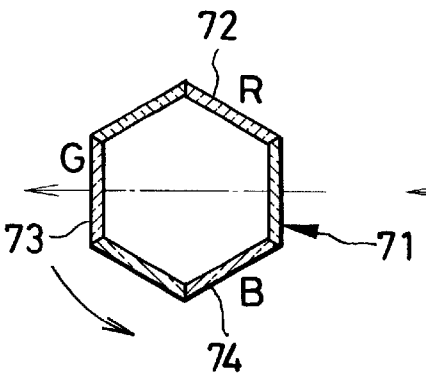
Figure 17C:
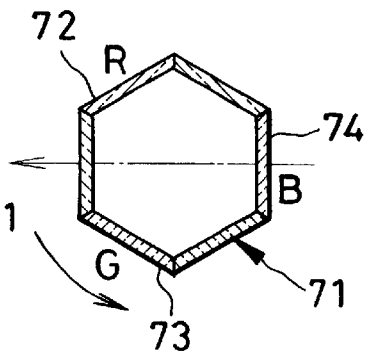
Figure 17D:
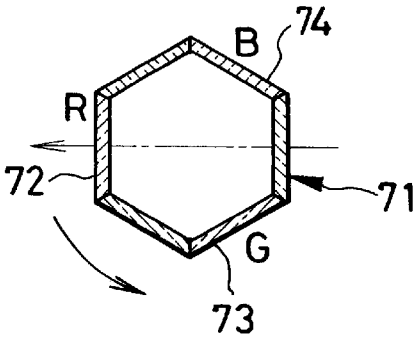
Figure 17E:
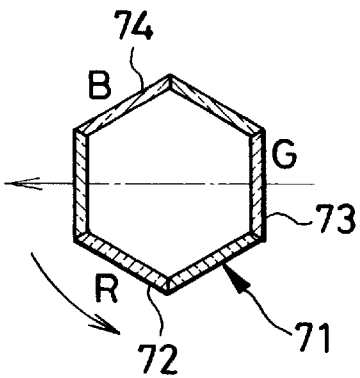
Figure 17F:
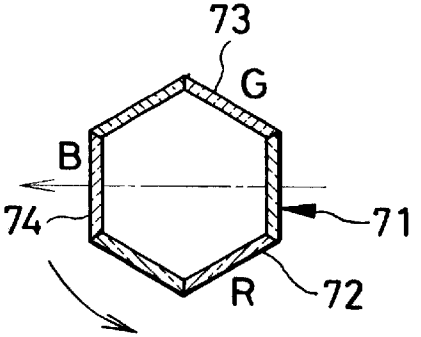
Figure 17G:
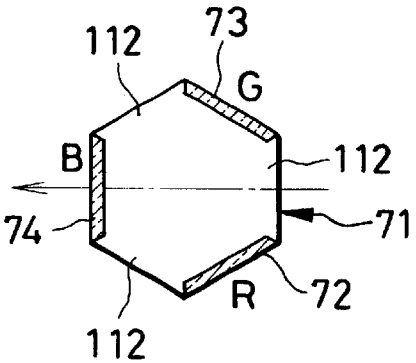
FIG. 17G is a cross section illustrating a color separation filter unit similar to that of FIGS. 17A–17F but with the openings.

In FIGS. 16A–16F, a preferred embodiment is depicted, in which a color separation filter unit 67 includes the ND filters 66 arranged alternately with the color filters 31–33. The ND filters 66 operate as transmission portions without selectivity of a wavelength. Also, FIGS. 17A–17F illustrate a color separation filter unit 71 in a shape of a polygonal prism. The peripheral face of the color separation filter unit 71 is divided into six portions, and provided with transparent plates 128 or transmission portions. Furthermore, the total number of the color filters and the transmission portions can be 6(2n+1) in the manner described above. In FIG. 17G, an embodiment is depicted, in which the openings 112 are formed instead of the transparent plates 128.

Figure 18A:
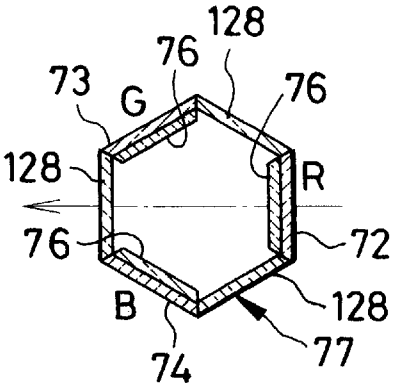
FIGS. 18A–18F are cross sections illustrating another color separation filter unit with the ND filters behind the color filters.
Figure 18B:
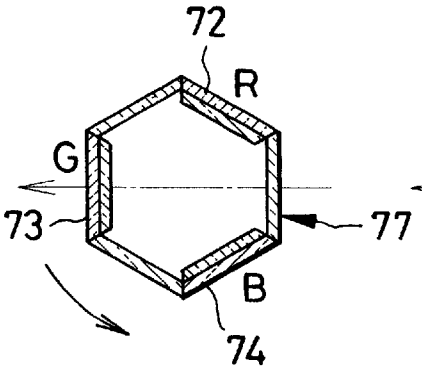
Figure 18C:
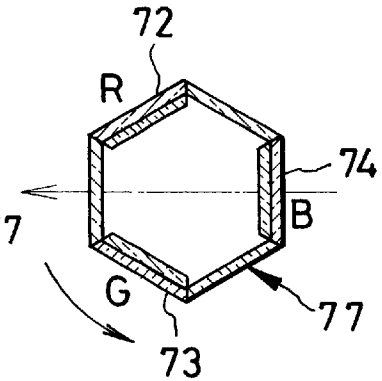
Figure 18D:
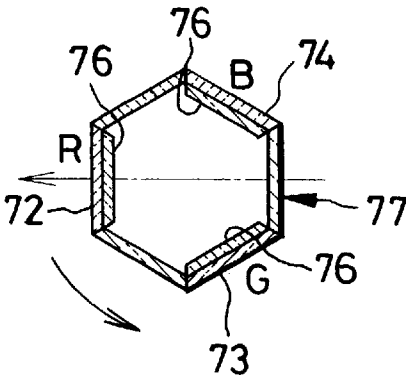
Figure 18E:
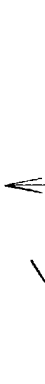
Figure 18F:
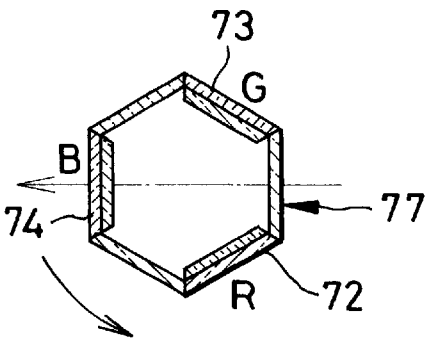
Figure 18G:
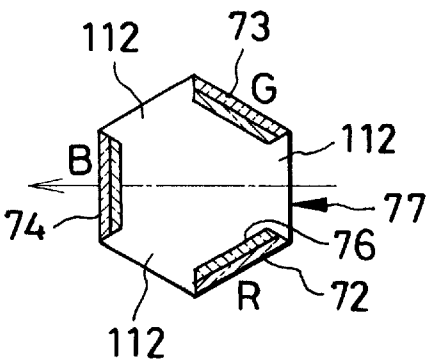
FIG. 18G is a cross section illustrating a color separation filter unit similar to that of FIGS. 18A–18F but with the openings.
Figure 19A:
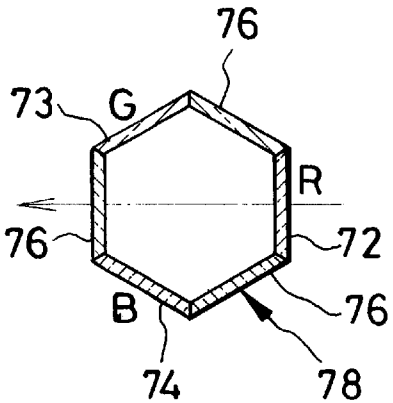
FIGS. 19A–19F are cross sections illustrating another color separation filter unit with the ND filters between the color filters.
Figure 19B:
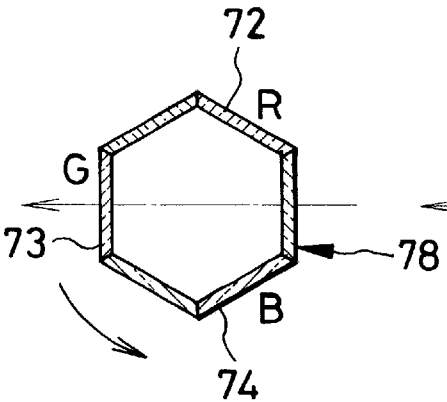
Figure 19C:
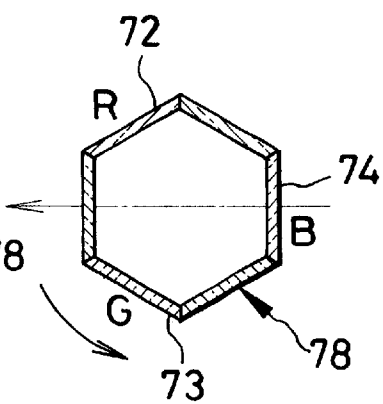
Figure 19D:
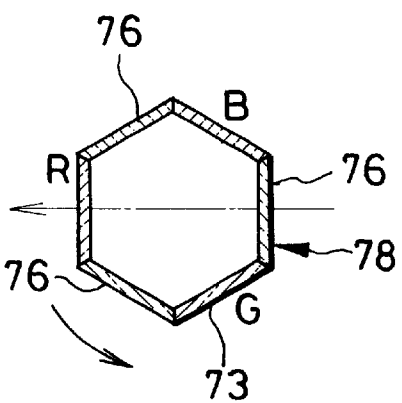
Figure 19E:
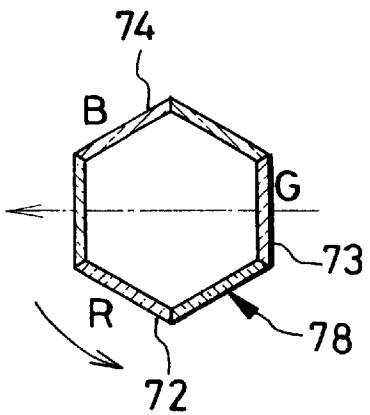
Figure 19F:
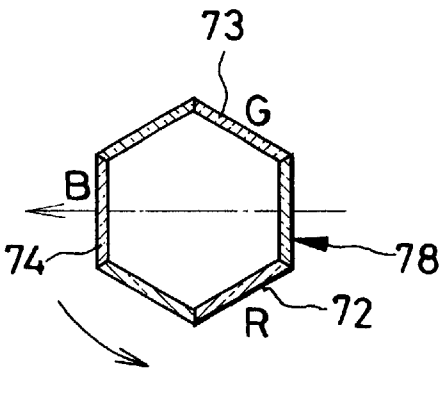

In FIGS. 18A–18F, a preferred color separation filter unit 77 is illustrated, in which ND filters 76 are attached to color filters 72, 73 and 74. Also, FIG. 18G illustrates a color separation filter having the openings 112. In FIGS. 19A–19F, a color separation filter unit 78 has the color filters 72–74 and the ND filters 76 arranged alternately with the color filters 72–74.

Figure 20:
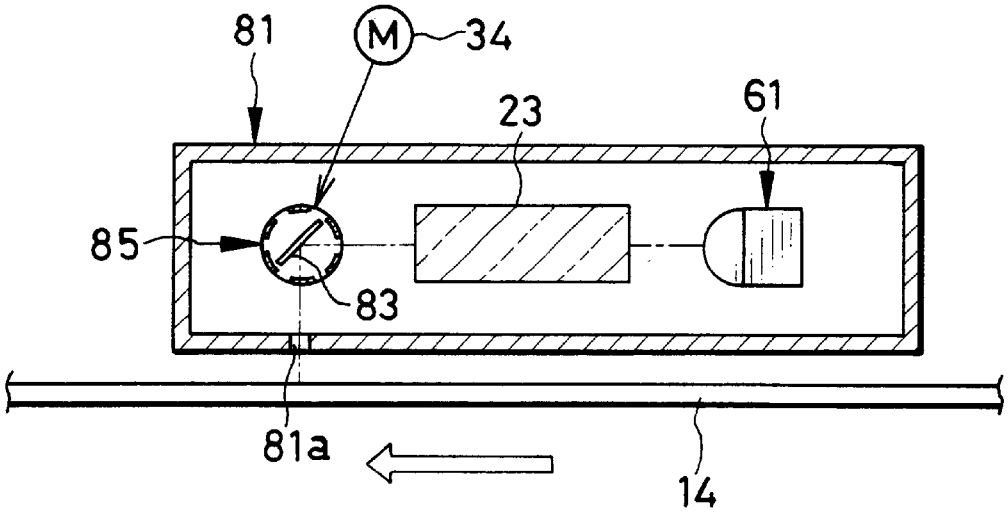
FIG. 20 is a vertical section illustrating another preferred printing head in which a reflector is contained in a color separation filter unit.
Figure 21:
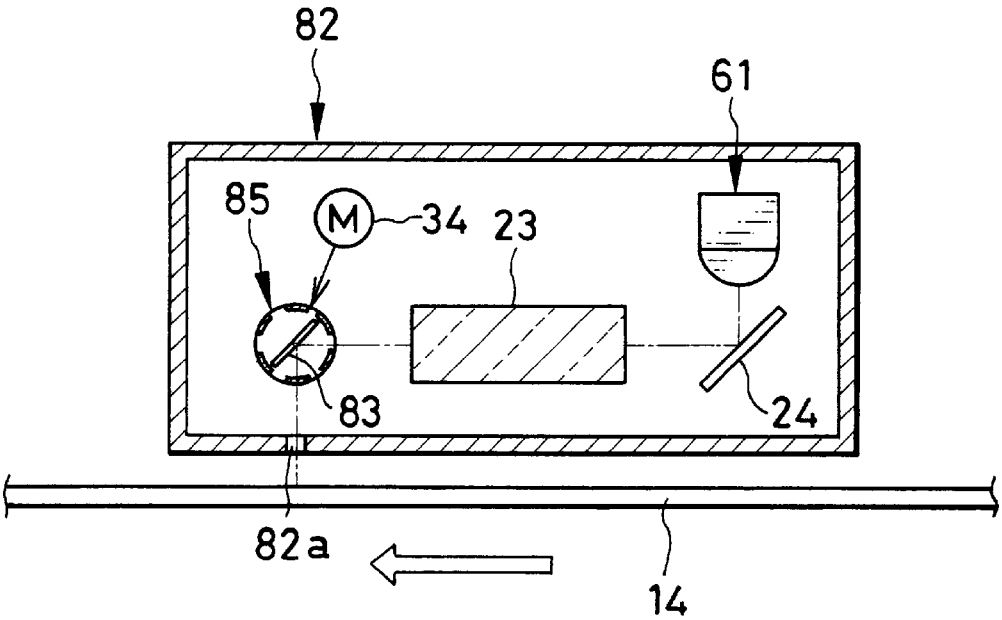
FIG. 21 is a vertical section illustrating a printing head similar to that of FIG. 20 but with a reflector between a color separation filter unit and a light source.
Figure 22:
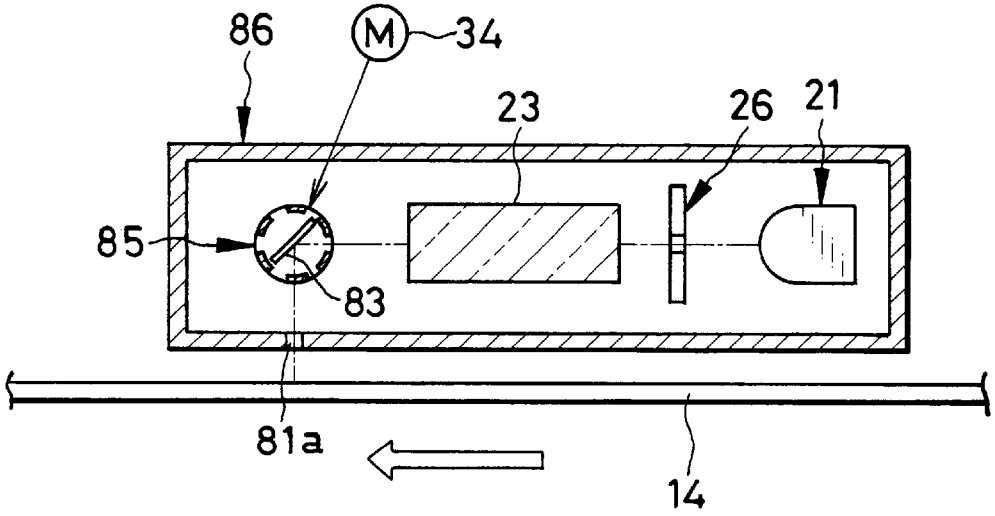
FIG. 22 is a vertical section illustrating a printing head similar to that of FIG. 20 but in which an LCD micro shutter is incorporated.
Figure 23:
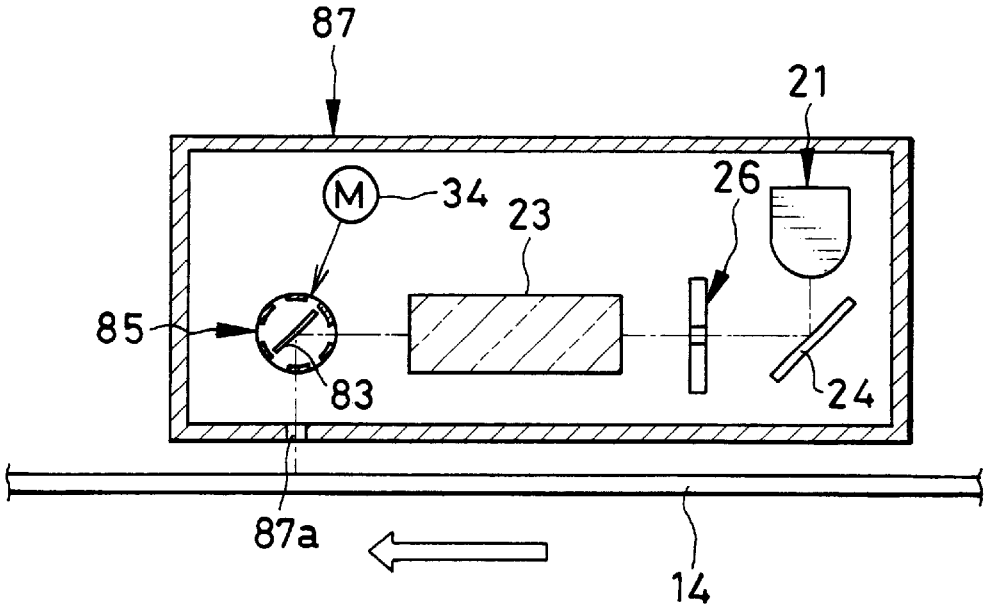
FIG. 23 is a vertical section illustrating a printing head similar to that of FIG. 22 but with a reflector between a color separation filter unit and a light source.
Figure 24A:
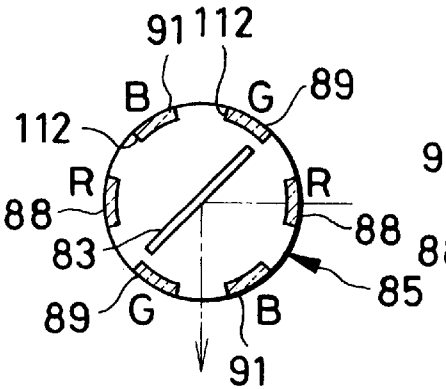
FIGS. 24A–24F are cross sections illustrating the color separation filter unit in the printing head of FIGS. 20–23.
Figure 24B:
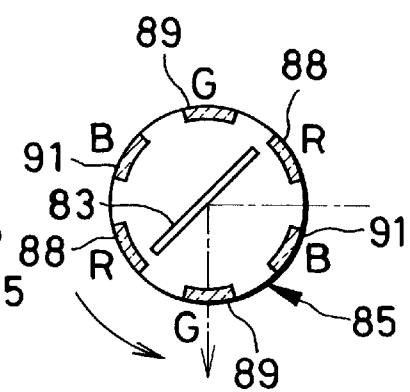
Figure 24C:
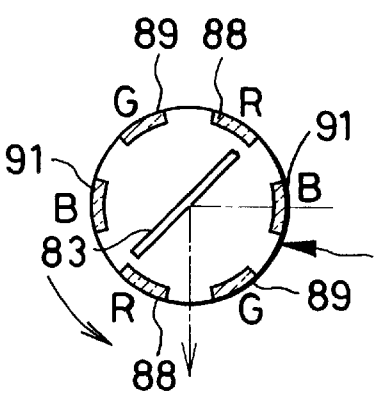
Figure 24D:
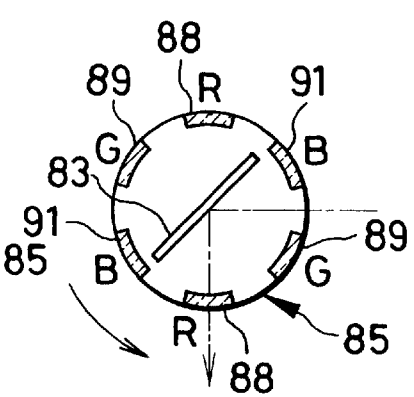
Figure 24E:
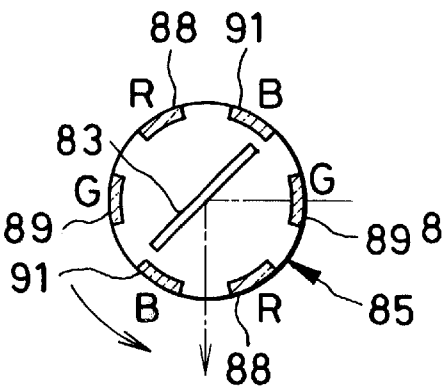
Figure 24F:
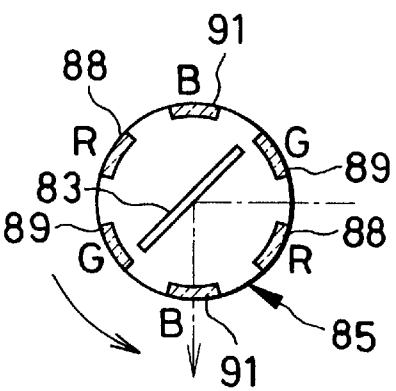
Figure 25A:
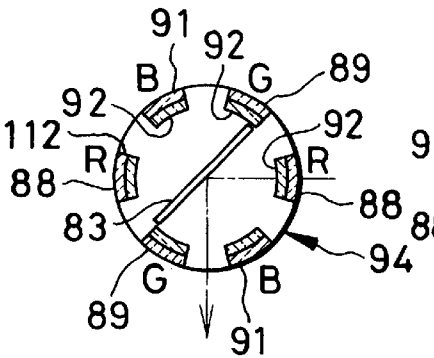
FIGS. 25A–25F are cross sections illustrating a color separation filter unit similar to that of FIGS. 24A–24F but with the ND filters behind the color filters.
Figure 25B:
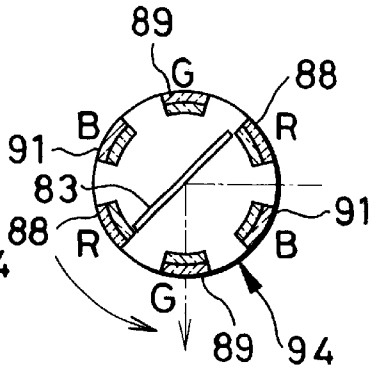
Figure 25C:
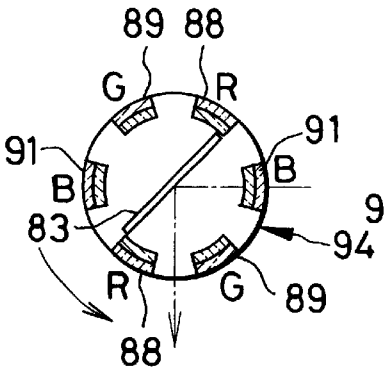
Figure 25D:
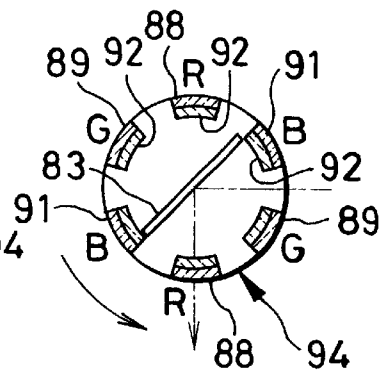
Figure 25E:
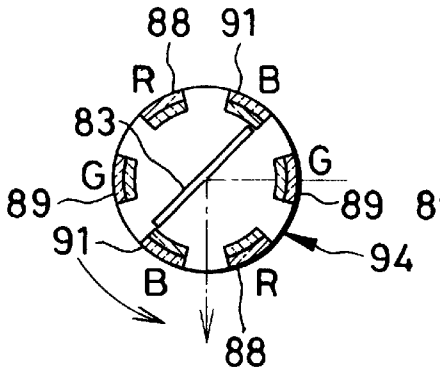
Figure 25F:
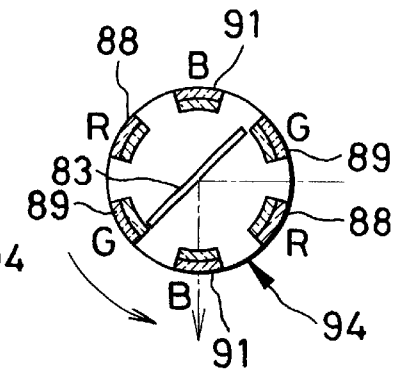
Figure 26D:
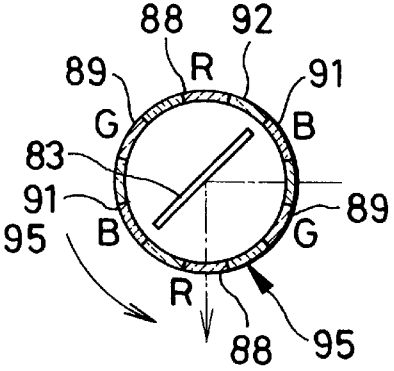
FIGS. 26A–26F are cross sections illustrating a color separation filter unit with the ND filters between the color filters.
Figure 26C:
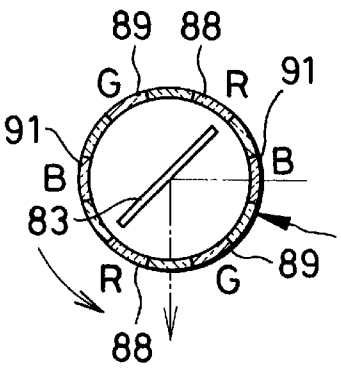
Figure 26B:
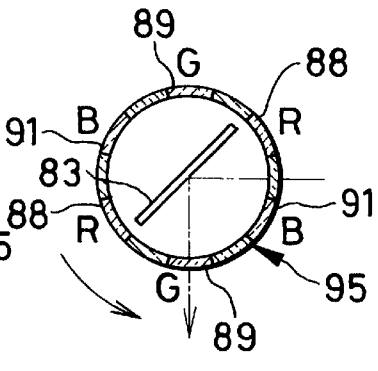
Figure 26A:
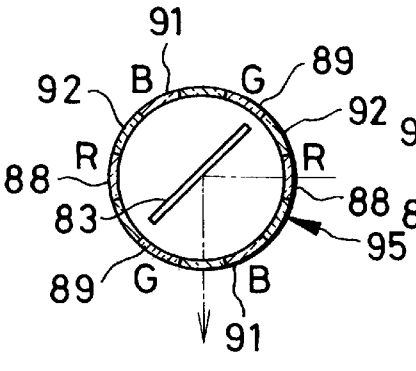
Figure 26F:
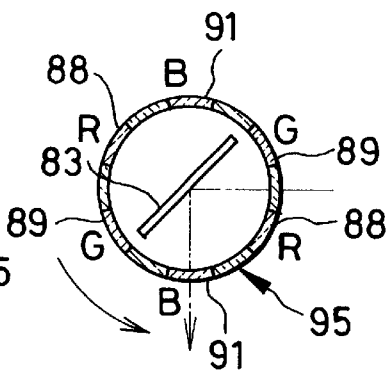
Figure 26E:
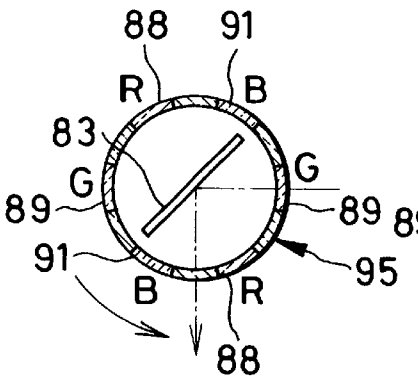
Figure 27A:
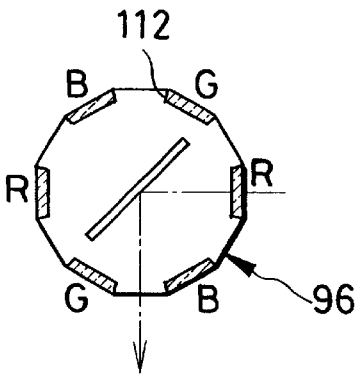
FIGS. 27A–27F are cross sections illustrating a color separation filter unit in a shape of a hexagonal prism.
Figure 27B:
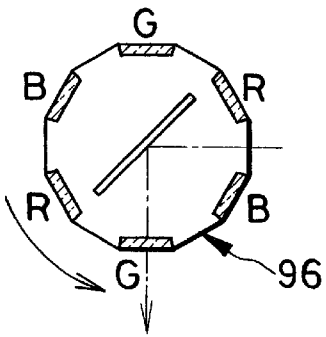
Figure 27C:
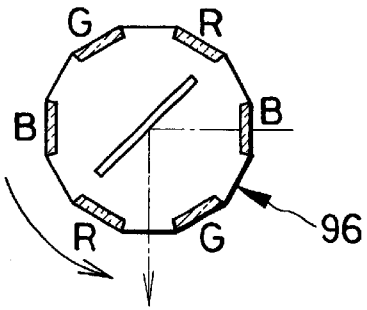
Figure 27D:
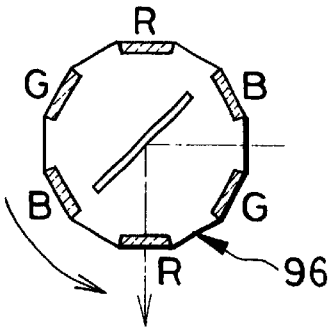
Figure 27E:
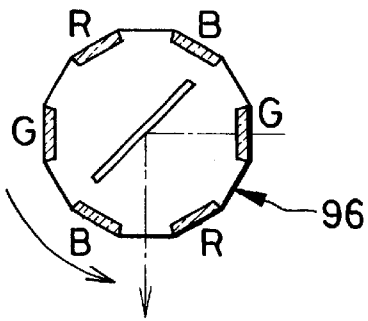
Figure 27F:
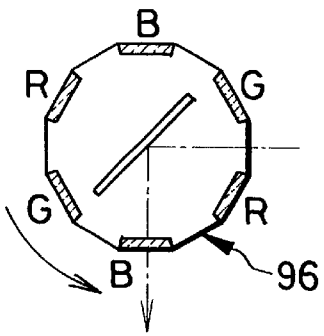
Figure 28A:
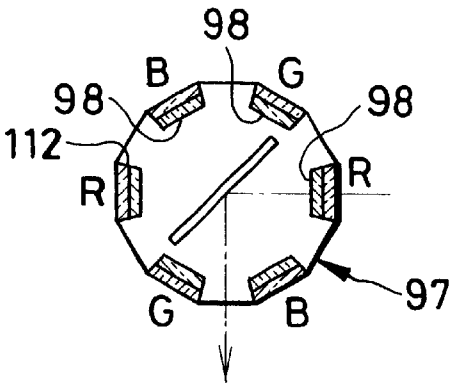
FIGS. 28A–28F are cross sections illustrating a color separation filter unit with the ND filters behind the color filters.
Figure 28B:
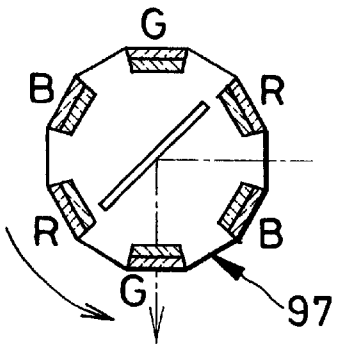
Figure 28C:
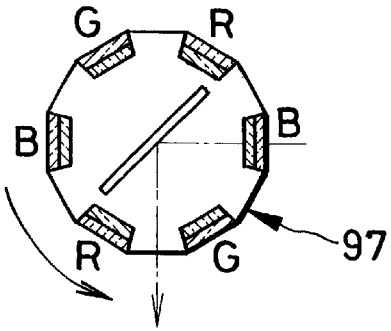
Figure 28D:
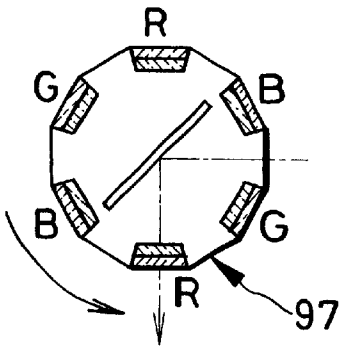
Figure 28E:
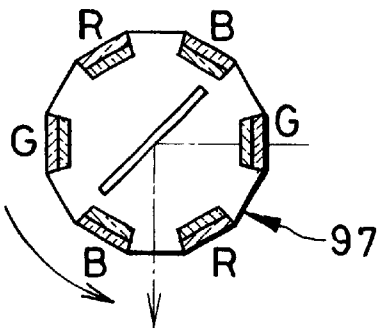
Figure 28F:
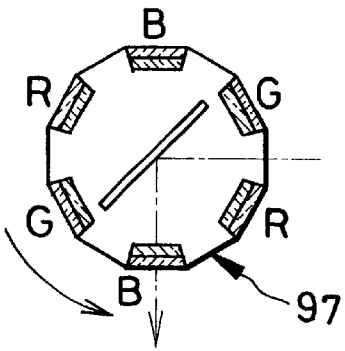
Figure 29A:
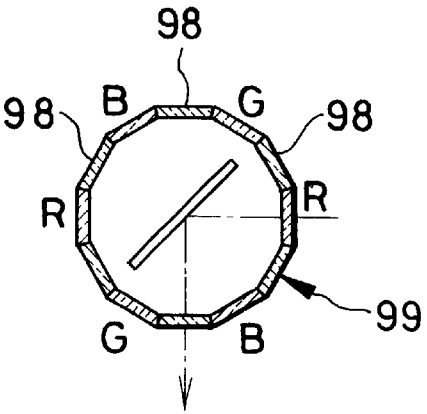
FIGS. 29A–29F are cross sections illustrating a color separation filter unit with the ND filters between the color filters.
Figure 29B:
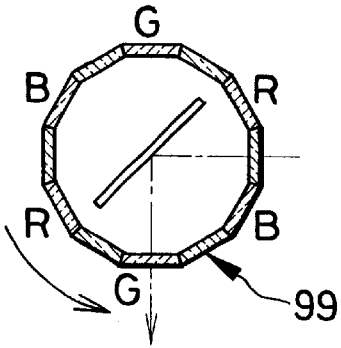
Figure 29C:
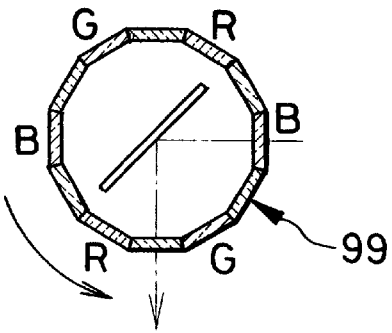
Figure 29D:
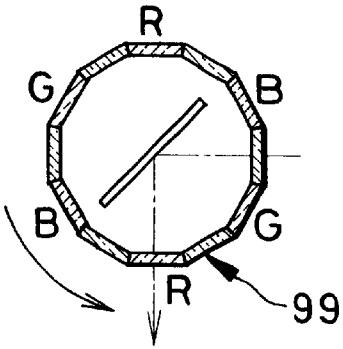
Figure 29E:
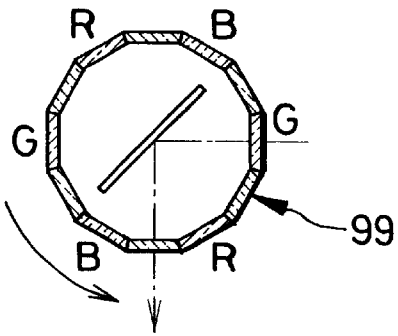
Figure 29F:
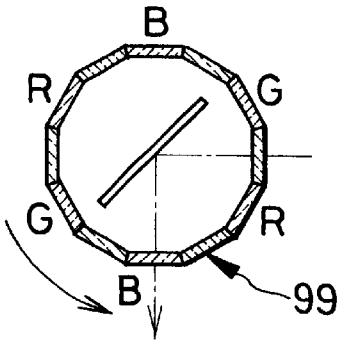

In FIGS. 20 and 21, other preferred printing heads 81 and 82 are depicted, in which the light-emitting element array 61 is incorporated and a color separation filter unit 85 is provided with a reflector 83. In FIG. 20, a light-emitting surface of the light-emitting element array 61 is directed horizontally. In FIG. 21, the light-emitting surface of the light-emitting element array 61 is directed downwards. In FIG. 22 and 23, printing heads 86 and 87 have the light source 21 and the LCD micro shutter 26 instead of the light-emitting element array 61.

The color separation filter unit 85 to be contained in the printing heads 81, 82, 86 and 87 has the reflector 83 as illustrated in FIGS. 24A–24F. The reflector 83 reflects light from an entrance position of the color separation filter unit 85 with approximately a right angle toward an exit position. The periphery of the color separation filter unit 85 is divided into 12 portions in which color filters 88, 89 and 91 are arranged alternatively with the openings. Thus, a single one of the color filters 88, 89 and 91 is located in either one of the entrance position and exit position in a manner irrespective of the rotational position of the color separation filter unit 85. Note that the number of portions into which the periphery of the color separation filter unit 85 is divided may be different from 12, and may be 12(2n+1) where n is an integer equal to or more than zero. In the present embodiment, the printing head can have a small size as the reflector 83 is contained in the color separation filter unit 85.

In FIGS. 25A–25F, a color separation filter unit 94 has ND filters 92 attached directly to the color filters 88, 89 and 91. Note that, as described above, the ND filters 92 may be attached to filters of only one or two colors selected from the color filters 88, 89 and 91. Also, the ND filters 92 may be disposed behind the color filters 88, 89 and 91 with a space without direct contact. In FIGS. 26A–26F, a color separation filter unit 95 includes the ND filters 92 arranged alternately with the color filters 88, 89 and 91.

In FIGS. 27A–27F, a color separation filter unit 96 has a shape of a polygonal prism. The periphery of the color separation filter unit 96 is divided into 12 portions. Note that the number of portions into which the periphery of the color separation filter unit 96 is divided may be 12(2n+1) where n is an integer equal to or more than zero, which is similar to the embodiment of FIGS. 24A–24F. In FIGS. 28A–28F, a color separation filter unit 97 includes ND filters 98 attached to respectively the color filters. Note that the ND filters 98 may be disposed with a space to the color filters without a direct contact. In FIGS. 29A–29F, a preferred color separation filter unit 99 includes the color filters and the ND filters 98 arranged alternatively with the color filters.

It is to be noted that the openings 112 are formed for transmission of light in the color separation filter unit 85 of FIGS. 24A–24F, the color separation filter unit 94 of FIGS. 25A–25F, the color separation filter unit 96 of FIGS. 27A–27F, and the color separation filter unit 97 of FIGS. 28A–28F. Furthermore, transparent plates may be secured in place of the openings.

Note that, in any of the above embodiments, the optical printer is a line printer. Alternatively, a printer of the invention may be a serial printer in which a printing head is movable in a width direction of the instant photo film to record each line.

Figure 30:
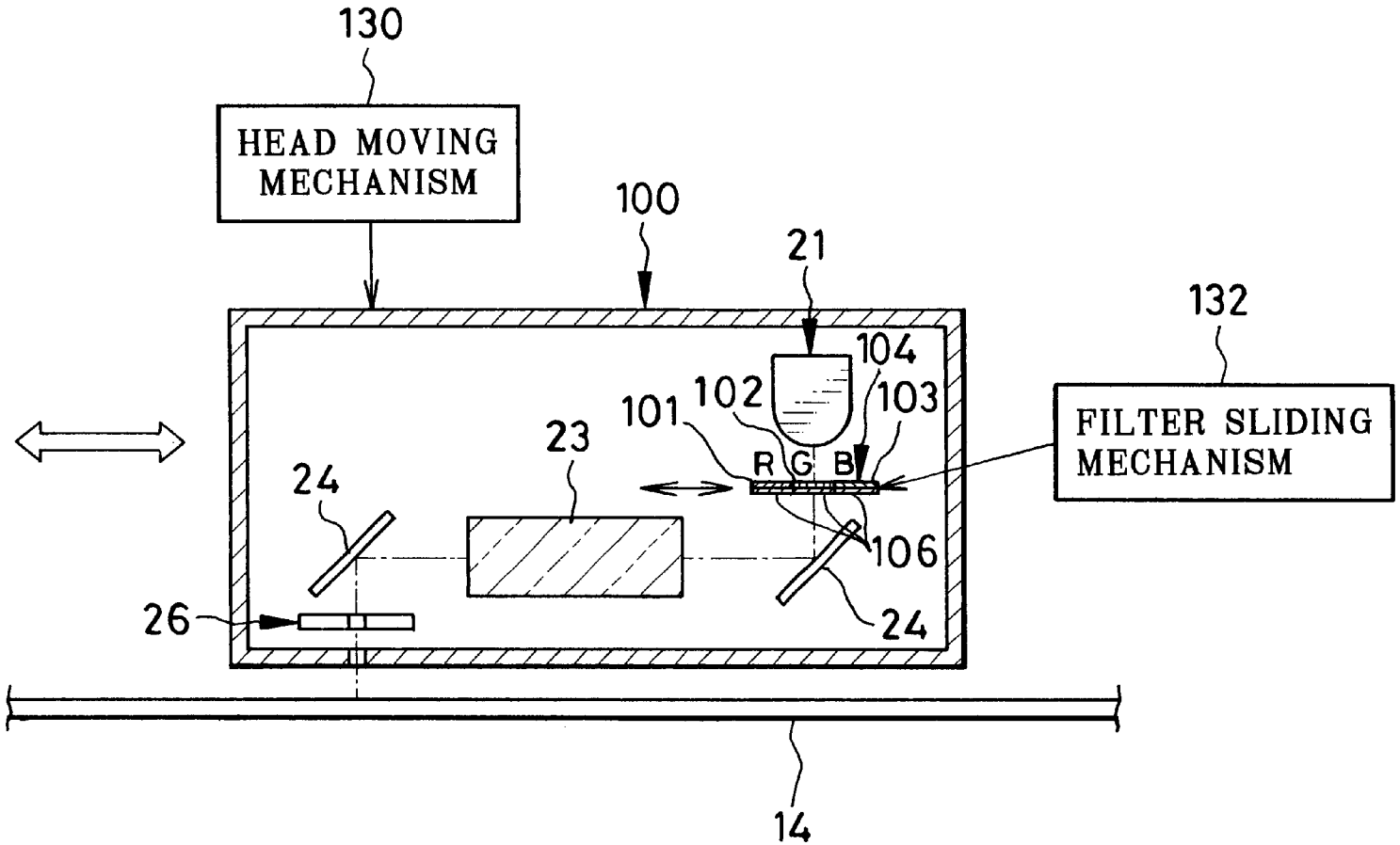
FIG. 30 is an explanatory view illustrating another preferred printing head with a slidable color separation filter unit.

In the present invention, ND filters may be attached to a color separation filter unit of a type different from the rotatable type. In FIG. 30, another preferred printing head 100 is depicted. A color separation filter unit 104 is constituted by color filters 101, 102 and 103 arranged in a manner of a single plate. One or more ND filters 106 are attached to the color separation filter unit 104. A filter sliding mechanism 132 slides the color separation filter unit 104 to insert the color filters 101–103 in the light path selectively.

The color separation filter unit 104 is formed as a single transparent plastic plate, in which coatings are applied to its surface to determine the color filters 101–103. The ND filters 106 are attached to a lower surface of the color filters 101–103. It is to be noted that the ND filters 106 may be disposed behind the color filters 101–103 with a space without direct contact.

A head moving mechanism 130 slides the printing head 100 in parallel with an exposure surface of the instant photo film 14. At first, the red color filter 101 is set in the light path. The printing head 100 moves by an amount of one frame, to take an exposure with red printing light. Then the green color filter 102 is set in the light path. The printing head 100 moves by an amount of the one frame, to take an exposure with green printing light. Finally, the blue color filter 103 is set to expose the frame with blue printing light. The ND filters 106 are operated to regularize density of the three colors easily.

Figure 31A:
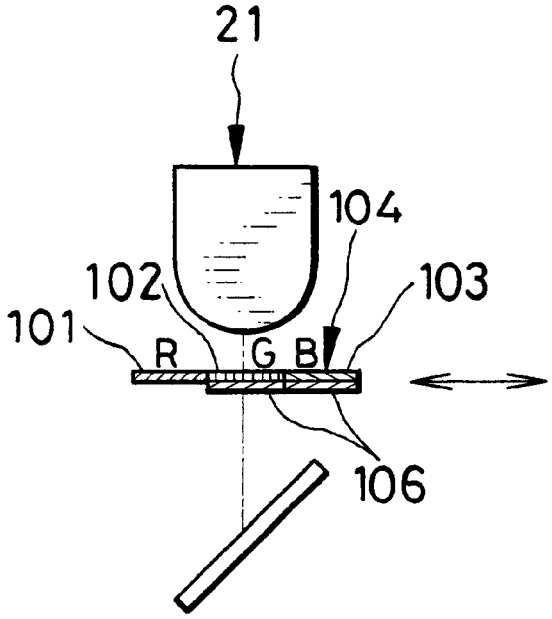
FIG. 31A is an explanatory view illustrating the color separation filter unit of FIG. 30.
Figure 31B:
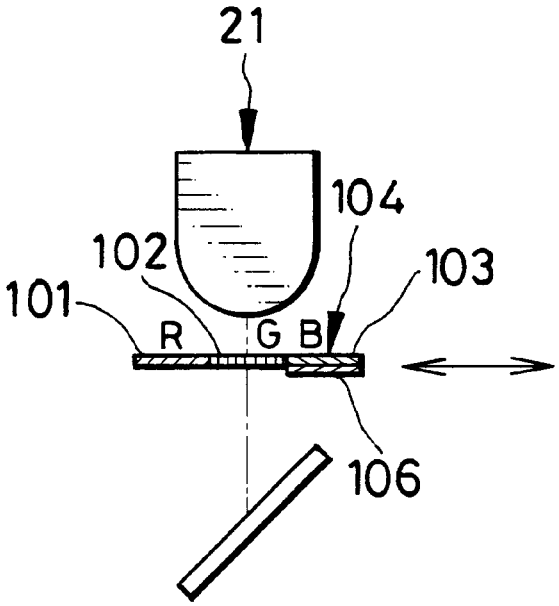
FIG. 31B is an explanatory view illustrating another color separation filter unit in which an ND filter is smaller.

In FIG. 31A, the ND filters 106 are attached to positions of only two of the color filters. In FIG. 31B, the ND filters 106 are attached to a position of only one of the color filters. Selection of only one or two of the color filters for attachment of the ND filters 106 is determined in consideration of the relative photo sensitivity of photosensitive layers of the instant photo film 14, transmittance of the color filters 101–103, or brightness in spectral distribution of the white color light source, as described above.

In any of the above embodiments, the printing light of the three colors are controlled by pixels to record one line at each time of an exposure. However, the liquid crystal display (LCD) micro shutter 26 or the light-emitting element array 61 may have a structure to record two or more lines in each exposure.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. An optical printer for recording a color image to a color photosensitive material, having a printing head including a light source, and a color separation filter unit for color separation of light from said light source into printing light of single colors, said optical printer comprising:

plural color filters, having selectivity of a wavelength, for converting said light from said light source into printing light of respectively said single colors;

plural transmission portions or openings without selectivity of a wavelength;

a filter drive mechanism for rotating said color separation filter unit; and a light amount adjustor for adjusting a light amount of said printing light by each of pixels according to density of said pixels while a color filter among said plural color filters associated with a respective color to be recorded is set in a light path, wherein said plural color filters and said plural transmission portions or openings are disposed to shape said color separation filter unit in a tubular shape, and arranged about a central axis extending in a main scan direction;

said plural transmission portions or openings are arranged alternately with said plural color filters, and one of said plural transmission portions or openings is located at a first position at each time that one of said plural color filters is located at a second position, said first position being one of an entrance position and an exit position, said second position being a remaining one of said entrance position and said exit position, said entrance position and said exit position being defined where said light travels into and out of said color separation filter unit, so that said plural color filters are set in said light path selectively in rotation of said color separation filter unit; and a reflector, disposed in said color separation filter unit, for reflecting said light to said exit position.

2. An optical printer as defined in claim 1, wherein a number of said plural color filters and a number of said transmission portions or openings are respectively 6(2n+1) where n is an integer equal to or more than zero, and said reflector is so disposed that said light is reflected substantially at a right angle.

3. An optical printer for recording a color image to a color photosensitive material, having a printing head including a light source, and a color separation filter unit for color separation of light from said light source into printing light of single colors, said optical printer comprising:

plural color filters, having selectivity of a wavelength, for converting said light from said light source into printing light of respectively said single colors;

plural transmission portions or openings without selectivity of a wavelength;

a filter drive mechanism for rotating said color separation filter unit; and a light amount adjustor for adjusting a light amount of said printing light by each of pixels according to density of said pixels while a color filter among said plural color filters associated with a respective color to be recorded is set in a light path, wherein said plural color filters and said plural transmission portions or openings are disposed to shape said color separation filter unit in a tubular shape, and arranged about a central axis extending in a main scan direction;

said plural transmission portions or openings are arranged alternately with said plural color filters, and one of said plural transmission portions or openings is located at a first position at each time that one of said plural color filters is located at a second position, said first position being one of an entrance position and an exit position, said second position being a remaining one of said entrance position and said exit position, said entrance position and said exit position being defined where said light travels into and out of said color separation filter unit, so that said plural color filters are set in said light path selectively in rotation of said color separation filter unit, wherein said color separation filter unit further includes a plurality of neutral density filters for reducing said light amount of said printing light of respective single colors, wherein said neutral density filters are disposed to lie on respectively said plural color filters.

4. An optical printer for recording a color image to a color photosensitive material, having a printing head including a light source, and a color separation filter unit for color separation of light from said light source into printing light of single colors, said optical printer comprising:

plural color filters, having selectivity of a wavelength, for converting said light from said light source into printing light of respectively said single colors;

plural transmission portions or openings without selectivity of a wavelength;

a filter drive mechanism for rotating said color separation filter unit; and a light amount adjustor for adjusting a light amount of said printing light by each of pixels according to density of said pixels while a color filter among said plural color filters associated with a respective color to be recorded is set in a light path, wherein said plural color filters and said plural transmission portions or openings are disposed to shape said color separation filter unit in a tubular shape, and arranged about a central axis extending in a main scan direction;

said plural transmission portions or openings are arranged alternately with said plural color filters, and one of said plural transmission portions or openings is located at a first position at each time that one of said plural color filters is located at a second position, said first position being one of an entrance position and an exit position, said second position being a remaining one of said entrance position and said exit position, said entrance position and said exit position being defined where said light travels into and out of said color separation filter unit, so that said plural color filters are set in said light path selectively in rotation of said color separation filter unit, and wherein said color separation filter has a prismatic shape.

5. An optical printer for recording a color image to a color photosensitive material, having a printing head including a light source, and a color separation filter unit for color separation of light from said light source into printing light of single colors, said optical printer comprising:

plural color filters, having selectivity of a wavelength, for converting said light from said light source into printing light of respectively said single colors;

plural transmission portions or openings without selectivity of a wavelength;

a filter drive mechanism for rotating said color separation filter unit; and a light amount adjustor for adjusting a light amount of said printing light by each of pixels according to density of said pixels while a color filter among said plural color filters associated with a respective color to be recorded is set in a light path, wherein said plural color filters and said plural transmission portions or openings are disposed to shape said color separation filter unit in a tubular shape, and arranged about a central axis extending in a main scan direction;

said plural transmission portions or openings are arranged alternately with said plural color filters, and one of said plural transmission portions or openings is located at a first position at each time that one of said plural color filters is located at a second position, said first position being one of an entrance position and an exit position, said second position being a remaining one of said entrance position and said exit position, said entrance position and said exit position being defined where said light travels into and out of said color separation filter unit, so that said plural color filters are set in said light path selectively in rotation of said color separation filter unit;

an encoder plate, secured to said color separation filter unit, having color information disposed in association with said plural color filters, for representing colors of said plural color filters;

a sensor for reading said color information and for generating a signal representing a color of one of said plural color filters set in said light path;

a controller, operated according to said signal, for determining a color of an image signal and timing of outputting said image signal, and for controlling said filter drive mechanism and said light amount adjuster.

6. An optical printer as defined in claim 5, wherein said plural color filters are disposed with respectively a first central angle about said central axis in said color separation filter unit;

said color information is disposed with respectively a second central angle about a central axis in said encoder plate, said second central angle being smaller than said first central angle;

said controller starts outputting said image signal after a portion of respectively said plural color filters comes in said light path, and finishes outputting said image signal before an entirety of respectively said plural color filters comes out of said light path.

7. An optical printer for recording a color image to a color photosensitive material, having a printing head including a light source, and a color separation filter unit for color separation of light from said light source into printing light of single colors, said optical printer comprising:

plural color filters, having selectivity of a wavelength, for converting said light from said light source into printing light of respectively said single colors;

plural transmission portions or openings without selectivity of a wavelength;

a filter drive mechanism for rotating said color separation filter unit; and a light amount adjustor for adjusting a light amount of said printing light by each of pixels according to density of said pixels while a color filter among said plural color filters associated with a respective color to be recorded is set in a light path, wherein said plural color filters and said plural transmission portions or openings are disposed to shape said color separation filter unit in a tubular shape, and arranged about a central axis extending in a main scan direction;

said plural transmission portions or openings are arranged alternately with said plural color filters, and one of said plural transmission portions or openings is located at a first position at each time that one of said plural color filters is located at a second position, said first position being one of an entrance position and an exit position, said second position being a remaining one of said entrance position and said exit position, said entrance position and said exit position being defined where said light travels into and out of said color separation filter unit, so that said plural color filters are set in said light path selectively in rotation of said color separation filter unit, and wherein said color photosensitive material is an instant photo film.

8. An optical printing method of recording a color image by exposing a color photosensitive material, comprising steps of:

converting light from a light source into printing light of plural colors by filtering, wherein said converting of light is effected by use of a color separation filter unit having a tubular shape and being rotatable about a central axis thereof, and including a reflector disposed in said color separation filter unit for reflecting the printing light from an incident path;

controlling a light amount of said printing light of said plural colors according to an image signal; and reducing said light amount of said printing light of at least one of said plural colors by filtering.

* * * * *